US010752020B2

(12) United States Patent
Milini

(10) Patent No.: US 10,752,020 B2
(45) Date of Patent: Aug. 25, 2020

(54) PRINTING ON FIBROUS MATERIAL

(71) Applicant: MS PRINTING SOLUTIONS S.R.L, Caronno Pertusella (VA) (IT)

(72) Inventor: Luigi Milini, Saronno (IT)

(73) Assignee: MS PRINTING SOLUTIONS S.R.L., Caronno Pertusella (VA) (IT)

( * ) Notice: Subject to any disclaimer, the term of this patent is extended or adjusted under 35 U.S.C. 154(b) by 0 days.

(21) Appl. No.: 16/745,157

(22) Filed: Jan. 16, 2020

(65) Prior Publication Data

US 2020/0147979 A1 May 14, 2020

Related U.S. Application Data

(63) Continuation of application No. 16/060,539, filed as application No. PCT/IB2016/057244 on Dec. 1, 2016, now Pat. No. 10,549,548.

(30) Foreign Application Priority Data

Dec. 11, 2015 (IT) ..... 102015000082543

(51) Int. Cl.
*B41J 3/407* (2006.01)
*B41J 11/00* (2006.01)

(52) U.S. Cl.
CPC ..... *B41J 3/4078* (2013.01); *B41J 11/007* (2013.01); *B41J 11/0015* (2013.01)

(58) Field of Classification Search
CPC ..... B41J 3/4078; B41J 11/0015; B41J 11/007
See application file for complete search history.

(56) References Cited

U.S. PATENT DOCUMENTS

2005/0206711 A1 9/2005 Milini
2009/0151625 A1 6/2009 Matsumoto et al.
2009/0293209 A1 12/2009 Chung et al.
2011/0057988 A1* 3/2011 Izumikawa ..... B41J 11/0015 347/21

(Continued)

FOREIGN PATENT DOCUMENTS

WO WO 2015/146182 10/2015

OTHER PUBLICATIONS

International Search Report in International Application No. PCT/IB2016/057244, dated Apr. 4, 2017, 16 pages.

*Primary Examiner* — Bradley W Thies
(74) *Attorney, Agent, or Firm* — Fish & Richardson P.C.

(57) ABSTRACT

A plant and a process for printing a sheet fibrous material. The plant includes a conveyor belt, a preparing station, and a printing station. The conveyor belt is configured for temporarily receiving in contact a first side of the sheet fibrous material and, during a predetermined operative condition, for continuously moving the sheet fibrous material along an advancement direction. The preparing station is configured for placing on the sheet fibrous material a treatment composition. The printing station is adapted to ink-print at least part of a second side, opposite to the first side, of the sheet fibrous material. The printing station includes a printing module which, during the predetermined operative condition, is configured for defining a print on an overall width of the sheet fibrous material, staying in a fixed position and printing the second side of the sheet fibrous material sliding on the conveyor belt.

20 Claims, 8 Drawing Sheets

(56) References Cited

U.S. PATENT DOCUMENTS

| | | | |
|---|---|---|---|
| 2013/0293617 | A1 | 11/2013 | Suzuki et al. |
| 2014/0043393 | A1 | 2/2014 | Takeuchi |
| 2018/0354275 | A1 | 12/2018 | Milini |

* cited by examiner

FIG.10
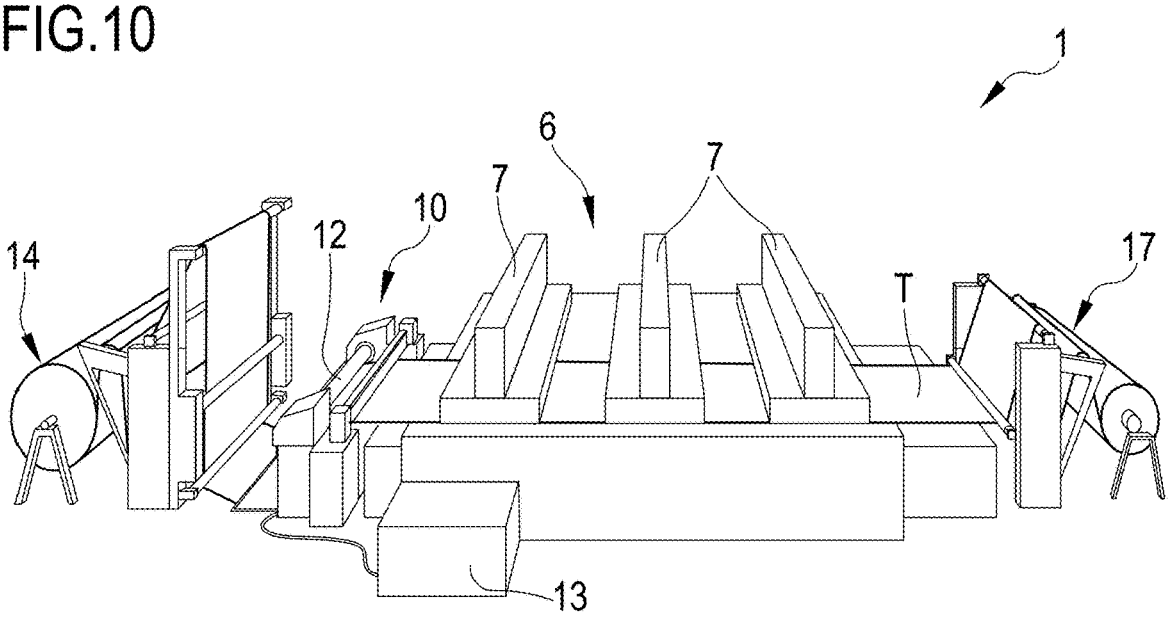
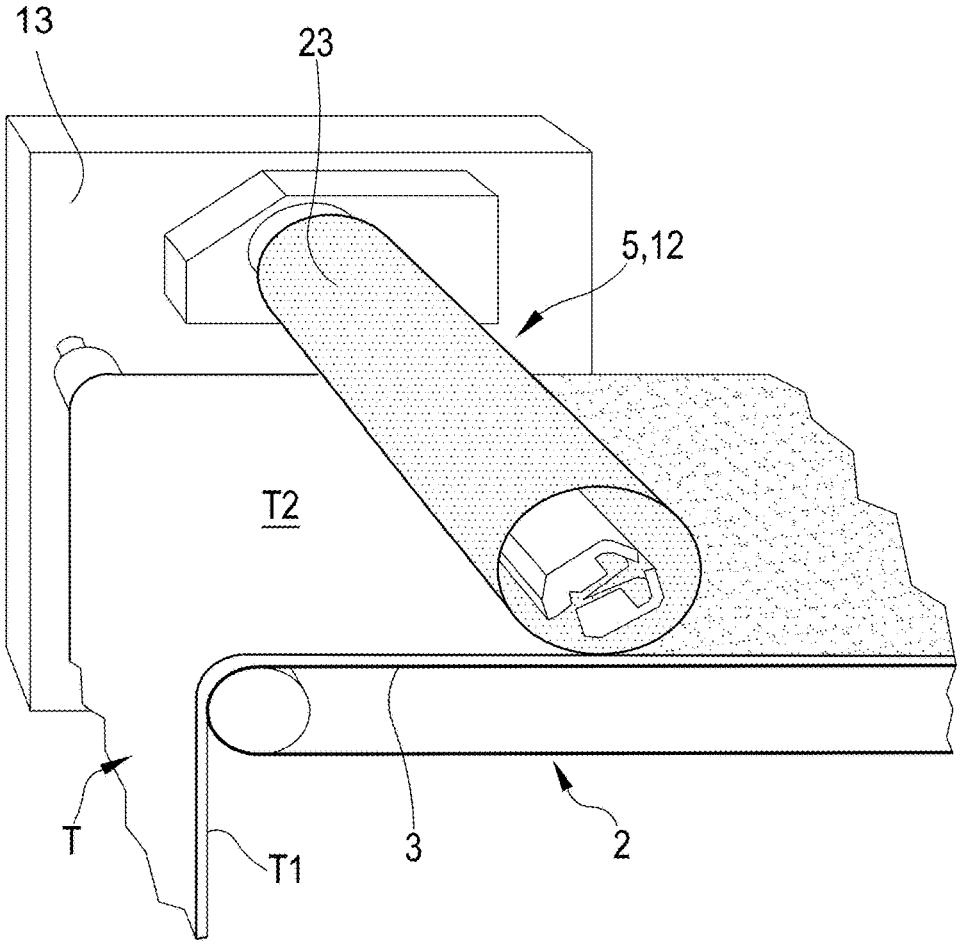
FIG.11

PRINTING ON FIBROUS MATERIAL

CROSS-REFERENCE TO RELATED APPLICATIONS

This application is a continuation of U.S. patent application Ser. No. 16/060,539, filed on Jun. 8, 2018, which is a U.S. national stage under 35 USC § 371 of International PCT Application Number PCT/IB2016/057244, filed on Dec. 1, 2016, which claims the benefit to Italian Patent Application Number 102015000082543, filed Dec. 11, 2015, all of which are hereby incorporated by reference in their entirety.

FIELD OF THE INVENTION

The present invention refers to a plant for printing, particularly for digitally printing, a fibrous material having a sheet-shape; the invention further refers to a process of printing, particularly of digitally printing, said sheet fibrous material. The plant and the associated process object of the invention can find an application in the field for printing fabrics and/or non-woven fabrics. The invention is generally, but in a non limiting way, applicable to the textile or knitted fabric or non-woven fabric industry.

STATE OF THE ART

As it is known, the conventional printing—in other words the one using printing silk-screen cylinders or frames—and the digital-type printing—in other words the one using one or more printing nozzle heads—are technologies used for applying inks or paints defining motives, patterns, colorations on sheet materials of different kind, such as for example, paper, fabrics, non-woven fabrics, fell, and more.

The fabrics, non-woven fabrics, or other fibrous materials having a laminar structure destined both to the conventional and digital printings, are subjected to a number of preparation steps, before the printing step, and to one or more steps of finishing the fabric, after the printing step. A suitable pre-treatment at least for the surface of the fibrous material, before the printing process, ensures to deposit the ink in the desired way and position and to suitably fix it to the fibrous material itself.

For example, the fibrous material to be printed can be treated by substances adapted to enable a suitable definition of the printed pattern on the fibrous material and to correctly fix the printing colours on the material itself: these treatments are for example performed by means of alkali-based or acid-based substances (according to the type of ink subsequently applied), thickener-based, anti-migration-based substances and/or moisture givers. These substances and the associated pre-treatment processes are known and used in the textile field and—generally—change as a function of the fabric and type of printing ink. The pre-treatment enables the ink drops to be fixed to the fibers of the material to be printed without forming marks and spreading around in an uncontrolled way: the preliminary step of treating the fabric therefore ensures a good colour yield and a suitable definition.

Particularly, in the digital printing processes, a suitable pre-treatment of the material to be printed, has a crucial importance. Actually, in the digital printing, jet heads having a plurality of nozzles having a small ink passage opening are used: in this situation, it is virtually impossible to directly add the ink because this latter could become, for example, too much viscous, which would prevent the ink from regularly passing through the heads, or could get chemical-physical characteristics which are not easily manageable by the systems controlling the same digital heads. Due to this reason, the material to be printed is previously treated and, only after, is subjected to the digital printing.

Now it is known a pre-treatment step providing the application of a liquid solution containing both anti-migration agents (preventing the dispersion of the printing ink) and agents adapted to enable to fix the printing colour on the fibrous material. These pre-treatment substances are typically applied by dipping the fibrous material in suitable tanks or by spraying them on it: the present techniques inevitably leave the material to be printed wet. Therefore, for enabling to print pre-treated fibrous materials, now it is provided a step of drying the material before the printing step and after the step of applying additives (by spraying or immersion in suitable tanks).

A first known type of an apparatus for pre-treating and digitally printing on sheet materials (fabrics included), is described in the patent EP1577101B1 (and in the associated patent application US 2005-206711A1), disclosing an apparatus provided with a closed-loop movable conveyor belt on which the sheet material to be printed can be fixed. The apparatus exhibits a pre-treatment substance applicator, a pre-treated material dryer and a printing device. Lastly, downstream the printing station, the apparatus exhibits a further drying device and then a station for steam-fixing the printed sheet.

With reference to an apparatus for pre-treating and digitally printing on sheet materials (fabrics included) it is known a second type described in the patent application WO2012069242 showing an apparatus provided with a station for unwinding the fibrous material, which is adapted to supply an impregnating station (pre-treating station). The impregnating station consists of a tank receiving a liquid solution of fixing agents configured for enabling to fix the printing colour on the fibrous material. The fibrous material is introduced in the tank so that the same can be completely dipped in the liquid solution (fixing agents).

The material, exiting the impregnating tank, is constrained to pass through squeezing rolls configured for removing part of the fixing solution from the fibrous material. After, the fibrous material is placed on a conveyor belt and printed. The printed fibrous material, exiting the conveyor belt, is delivered to a colour-fixing station which provides to heat the material by hot air or steam. The printed and fixed fibrous material, exiting the fixing station, is lastly wound in a roll.

Although the above cited apparatuses enable to pre-treat and print sheet fibrous materials, the Applicant has discovered that such apparatuses are however not devoid of some shortcomings and therefore are improvable under different aspects.

De facto, the presently known apparatuses provide an impregnating step which considerably wets the fibrous material so that the material itself, at the end of the impregnating step, cannot be immediately printed; actually, such apparatuses comprise the steps of squeezing and/or drying the sheet fibrous material in order to reduce as much as possible the moisture content. It is observed that these steps, besides complicating the structure of the plant and increasing the cost thereof, slow down the overall printing process with substantial shortcomings with reference to the production and therefore to the costs of a final product.

OBJECT OF THE INVENTION

Therefore, it is an object of the present invention to substantially overcome at least one of the shortcomings and/or limitations of the previous solutions.

A first object of the invention consists of providing a plant and an associated process enabling an efficient treatment of sheet fibrous materials, for example fabrics, knitted fabrics and/or non-woven fabrics, in order to supply the sheet material in optimal conditions for being printed, particularly for being digitally printed. Specifically, it is an object of the invention to provide a plant enabling a controlled and efficient step of pre-treating the sheet material wherein the same is wetted and/or impregnated with pre-treatment substances, for example thickening and/or anti-migration additives—for appropriately preparing the fibrous material for the printing.

A further object of the invention consists of providing a plant and an associated process of treating sheet fibrous materials, enabling to quickly treat the material itself; particularly, it is an object of the present invention to provide a plant enabling to minimize the treatment time of the sheet fibrous material in order to reduce to the smallest possible amount the times and costs of the printing process.

Then, it is an object of the invention to provide a plant and process provided with a station or step of pre-treating the fibrous material by suitable substances, for example thickening and/or anti-migration additives, which can be implemented at reasonable operating costs and offering a high productivity.

One or more of the above described objects which will better appear during the following description, are substantially satisfied by a plant for treating sheet fibrous materials and an associated treatment process according to one or more of the attached claims.

SUMMARY

The aspects of the invention are herein described in the following.

In a 1st aspect, it is provided a plant (1) for printing, particularly for digitally printing, a sheet fibrous material (T), said printing plant (1) comprising:

at least one conveyor belt (2) exhibiting an exposed surface configured for receiving the sheet fibrous material (T), the exposed surface defining an operative tract (3) configured for temporarily receiving in contact a first side (T1) of the sheet fibrous material (T) and for movably guiding this latter along an advancement direction (A), at least one printing station (6) configured for ink-printing, particularly for digitally printing, at least part of a side (T2) of the sheet fibrous material (T), optionally a second side of the fibrous material opposite to the first side (T1), said printing station (6) operating at the conveyor belt and being configured for printing the sheet fibrous material (T), optionally placed on the operative tract (3) of the conveyor belt (2).

In a 2nd aspect according to the 1st aspect, the conveyor belt (2), during a predetermined operative condition, is configured for continuously moving the sheet fibrous material (T) at a speed constantly greater than 0 along an advancement direction (A).

In a 3rd aspect according to the preceding claim, the printing station (6) comprises a printing module (7) which during said predetermined operative condition is configured for:

defining a print on the whole width of the sheet fibrous material (T), said width being measured normal to the advancement direction (A), staying in a fixed position and printing the second side (T2) of the sheet fibrous material (T) sliding on the operative tract (3).

In a 4th aspect according to the preceding aspect, the printing module (7) comprises a plurality of heads (8) configured for covering the whole width of the sheet fibrous material (T), said width being measured normal to the advancement direction (A).

In a 5th aspect according to anyone of the preceding aspects, the printing plant comprises at least one station (4) for preparing the sheet fibrous material (T), configured for treating at least part of a second side (T2) of the sheet fibrous material (T) opposite to the first side (T1).

In a 6th aspect according to the preceding aspect, the preparing station (4) is configured for placing, on the sheet fibrous material (T), a treatment composition (M) comprising at least one of: a treatment liquid and a treatment foam.

In a 7th aspect according to the aspect 5 or 6, the preparing station (4) is configured for modifying the surface hydrophobicity of at least part of the sheet fibrous material (T).

In an 8th aspect according to anyone of the aspects from 5 to 7, the preparing station (4) operates at the conveyor belt (2).

In a 9th aspect according to anyone of the aspects from 5 to 8, the preparing station is configured for treating the sheet fibrous material during said predetermined operative condition, particularly during the movement of the fibrous material continuously at a speed constantly greater than 0.

In a 10th aspect according to anyone of the aspects from 5 to 9, the preparing station (4) is configured for treating the sheet fibrous material (T) placed on the operative tract (3) of the conveyor belt (2), particularly the preparing station (4) is configured for placing, during the predetermined operative condition and on the sheet fibrous material (T) placed on the operative tract (3), a treatment composition (M) comprising at least one of: a treatment liquid and/or a treatment foam.

In an 11th aspect according to anyone of the aspects from 5 to 10, the preparing station is placed upstream the printing station with reference to the advancement direction (A) of the sheet fibrous material (T).

In a 12th aspect according to anyone of the aspects from 5 to 11, the preparing station (4) is configured for placing on the sheet fibrous material (T) a predetermined quantity of the treatment composition (M), said quantity of the treatment composition being selected so that the sheet fibrous material (T) itself exhibits a weight percentage per square meter variation, between a section immediately upstream and a section immediately downstream the preparing station (4), comprised between 10% and 50%.

In a 13th aspect according to anyone of the aspects from 5 to 12, wherein the preparing station (4) is configured for placing on the sheet fibrous material (T) a predetermined quantity of the treatment composition (M), said quantity of the treatment composition (M) being selected so that the sheet fibrous material (T) itself exhibits a weight percentage per square meter variation, between a section immediately upstream the preparing station and a section immediately upstream the printing station (6), comprised between 10% and 50%.

In a 14th aspect according to anyone of the aspects from 5 to 13, the preparing station (4) is configured for placing on the sheet fibrous material (T) a predetermined quantity of the treatment composition (M) selected so that the sheet fibrous material (T) itself exhibits a weight percentage per square meter variation, between a section immediately downstream the preparing station (4) and a section immediately upstream the printing station (6), comprised between 0% and 10%.

In a 15th aspect according to anyone of the aspects from 6 to 14, the preparing station is configured for placing said predetermined quantity of the treatment composition on the sheet fibrous material (T) sliding on the operative tract (3) of the conveyor belt (2).

In a 16th aspect according to anyone of the aspects from 6 to 15, the preparing station (4) comprises at least one applicator (5) configured for placing on the second side (T2) of the sheet fibrous material (T) placed on the operative tract, the treatment composition (M), said applicator (5) comprising at least one selected in the group among:

- a spreading doctor blade (19) placed transversally to the motion of the conveyor belt and spaced above the operative tract (3),
- a spray dispenser (18) spaced above the operative tract (3),
- an applicator roll with an associated respective doctor blade for adjusting a thickness of the treatment composition deposited on a lateral surface of the applicator roll, this latter being placed with the rotation axis transversal to motion of the conveyor belt (2) and with a lateral surface spaced above the operative tract (2) of the conveyor belt (2),
- a drum (23) placed with the rotation axis transversal to the motion of the conveyor belt and with the lateral surface spaced above the operative tract of the conveyor belt, the drum exhibiting a hollow interior destined to receive a predetermined quantity of the treatment composition and being provided with a predetermined number of nozzles or slits for dispensing the same,
- a distributor (25) comprising a reservoir (26) configured for receiving the treatment composition (M), the reservoir (26) exhibiting at least one dispensing nozzle (27) defining an outlet of the reservoir (26), the nozzle (27) extending transversally to the motion of the conveyor belt (2) along the whole width of this latter, the distributor (25) comprises one or more pushers, for example one or more toothed wheels, placed inside the reservoir and configured for supplying the treatment composition (M) from the nozzle (27).

In a 17th aspect according to anyone of the aspects from 5 to 16, the preparing station (4) and printing station (6) are placed immediately consecutive to each other along the advancement direction (A) of the sheet fibrous material (T).

In an 18th aspect according to anyone of the aspects from 5 to 17, the conveyor belt (2), during the operative condition, is configured for continuously moving the sheet fibrous material (T) through the preparing station (4) and printing station (6).

In a 19th aspect according to anyone of the aspects from 4 to 18, between the preparing station (4) and printing station (6) it is not present a station for drying the sheet fibrous material (T).

In a 20th aspect according to anyone of the preceding aspects, the printing plant (1) comprises at least one control unit (9) active on the conveyor belt (2) and configured for commanding the movement of said conveyor belt (2).

In a 21st aspect according to the preceding aspect, the control unit (9) is configured for commanding the movement of the conveyor belt (2) for defining the operative condition wherein said conveyor belt (2) is configured for continuously moving, along an advancement direction (A), the sheet fibrous material (T) at a speed constantly greater than 0, particularly comprised between 20 and 100 m/min, still more particularly comprised between 30 and 70 m/min.

In a 22nd aspect according to the aspect 20 or 21, the control unit (9) is connected to the printing station (6) and is configured for:

- commanding the movement of the conveyor belt (2),
- commanding the printing station (6) in order to manage the ink-printing on the sheet fibrous material (T), particularly for managing the ink-printing during the operative condition.

In a 23rd aspect according to anyone of the aspects from 20 to 22, the control unit (9) is active on the preparing station (4), said control unit (9) being configured for:

- commanding the movement of the conveyor belt (2),
- commanding the preparing station (4) for managing the application of the predetermined quantity of the treatment composition (M) on the sheet fibrous material (T).

In a 24th aspect according to the preceding aspect, the control unit (9) is configured for:

- receiving a signal related to the movement of the conveyor belt (2),
- calculating, as a function of said signal, the movement speed of the sheet fibrous material (T) along the advancement direction (A),
- as a function of the movement speed of the fibrous material (T), commanding to supply a predetermined quantity of the treatment composition (M).

In a 25th aspect according to the preceding aspect, the control unit (9), as a function of the movement speed of the fibrous material (T), is configured for commanding to supply a predetermined quantity of the treatment composition (M) so that:

- the sheet fibrous material (T) exhibits a weight percentage per square meter variation, between a section immediately upstream and one immediately downstream the preparing station (4), comprised between 10% and 50%,
- the sheet fibrous material (T) exhibits a weight percentage per square meter variation, between a section immediately downstream the preparing station (4) and one immediately upstream the painting station (6), comprised between 0% and 10%.

In a 26th aspect according to anyone of the aspects from 20 to 25, the control unit (9) is configured for managing the movement speed of the conveyor belt (2) so that, during the operative condition of the same, the travelling time of a point of the sheet fibrous material (T), from an outlet of the preparing station (4) to an inlet of the printing station (6), is less than 60 sec, particularly less than 30 sec, still more particularly falls in a range comprised between 0.5 and 20 sec.

In a 27th aspect according to anyone of the aspects from 5 to 26, the preparing station (4) is configured for increasing the surface hydrophobicity of at least part of the sheet fibrous material (T) passing through said preparing station (4).

In a 28th aspect according to anyone of the aspects from 5 to 27, the preparing station (4) is configured for increasing the surface hydrophobicity of the whole second side (T2) of the sheet fibrous material (T) passing through said preparing station (4).

In a 29th aspect according to anyone of the aspects from 5 to 28, the preparing station (4) comprises at least one plasma treating device (11) configured for defining a treating environment wherein at least one portion of the fibrous material is received and wherein an ionized gas is present.

In a 30th aspect according to the preceding aspect, the plasma treating device (11) comprises at least one first and one second electrodes (11*a*, 11*b*) spaced from and facing each other, said first and second electrodes (11*a*, 11*b*) being configured for receiving in between them the sheet fibrous material (T) passing through said controlled environment.

In a 31st aspect according to the preceding aspect, the plasma treating device (11) comprising an electric field generator connected to said first and second electrodes by a circuit, said generator being configured for defining, between said first and second electrodes, a predetermined potential difference adapted to enable to form said ionized gas.

In a 32nd aspect according to the preceding aspect, the potential difference defined between said first and second electrodes (11*a*, 11*b*) is comprised between 1 and 50 kV, particularly between 5 and 25 kV.

In a 33rd aspect according to anyone of the aspects from 29 to 32, the plasma treating device (11) is configured for generating plasma in said treating environment by using one or more of the following gases: air, nitrogen, nitrogen oxide (NO), ammonia, inert gases such as for example argon and helium, oxygen, hydrogen, carbon dioxide ($CO_2$), fluorinated gases such as for example $SF_6$ and $SOF_6$, hydrocarbon gases such as for example methane and ethane, fluorocarbon gases such as for example $CF_4$ and $C_2F_6$, considered alone or in a mixture, preferably nitrogen, still more preferably 2 $l_n$/min nitrogen;

optionally, the plasma device (11) is configured for generating plasma in a treating environment by using one or more of said gases mixed with one or more of: water vapour, hexamethyldisiloxane vapours of ammonium (HMDSO), and vapours of other silanes, siloxanes, hydrocarbons and perfluorinated compounds.

In a 34th aspect according to anyone of the aspects from 30 to 33, the first and second electrodes (11*a*, 11*b*) exhibit respective active surfaces facing each other, which exhibit a maximum distance from each other less than 20 mm, particularly comprised between 1 and 12 mm.

In a 35th aspect according to anyone of the aspects from 29 to 34, the plasma treating device (11) is configured for defining a predetermined dose defined by a power per surface unit transmitted by an electric discharge supplied by the treating device (11) itself of the sheet fibrous material (T) moving from the preparing station (4), wherein such power is less than 3,000 W*min/$m^2$, preferably is comprised between 30 and 10,000 W*min/$m^2$, still more preferably comprised between 500 and 800 W*min/$m^2$, the dose being defined as described in the specification.

In a 36th aspect according to anyone of the aspects from 29 to 34, the preparing station (4) is placed upstream the conveyor belt (2) with respect to the advancement direction (A) of the sheet fibrous material (T).

In a 37th aspect according to anyone of the preceding aspects, the printing plant (1) comprises at least one treating station (10) configured for placing on at least part of the second side (T2) of the sheet fibrous material (T) a treatment composition (N).

In a 38th aspect according to the preceding aspect, the treatment composition placed by the treating station (10) comprises at least one among:

an anti-migration agent, a pH control agent, a hydrotropic agent.

In a 39th aspect according to the aspect 37 or 38, the treating station (10) is distinct and separated from the preparing station (4).

In a 40th aspect according to anyone of the aspects from 37 to 39, the treating statin (10) is placed downstream the preparing station (4) with respect to the advancement direction (A) of the sheet fibrous material (T).

In a 41st aspect according to anyone of the aspects from 37 to 40, the treating station (10) is configured for placing on at least part of the second side (T2) of the sheet fibrous material (T) a treatment composition (N) comprising at least one of: a pH control agent and a hydrotropic agent.

In a 42nd aspect according to anyone of the aspects from 37 to 41, the treating station (10) comprises at least one applicator (12) configured for placing on the second side (T2) of the sheet fibrous material (T) the treatment composition (10), said applicator (12) comprising at least one among:

a spreading doctor blade (19) placed transversally to the motion of the conveyor belt and spaced above the operative tract (3), a spray dispenser (18) spaced above the operative tract (3), an applicator roll with an associated respective doctor blade for adjusting a thickness of the treatment composition deposited on a lateral surface of the applicator roll, this latter being placed with the rotation axis transversal to the motion of the conveyor belt (2) and with the lateral surface spaced above the operative tract (3) of the conveyor belt (2), a drum (23) placed with the rotation axis transversal to the motion of the conveyor belt and with the lateral surface spaced above the operative tract of the conveyor belt, the drum exhibiting a hollow interior destined to receive a predetermined quantity of the treatment composition and being provided with a predetermined number of nozzles or slits for supplying the same, a distributor (25) comprising a reservoir (26) configured for receiving the treatment composition (N), the reservoir (26) exhibiting at least one dispensing nozzle (27) defining an outlet of the reservoir (26), the nozzle (27) extending transversally to the motion of the conveyor belt (2) along the whole width of this latter, the distributor (25) comprises one or more pushers, for example one or more toothed wheels, placed inside the reservoir and configured for supplying the treatment composition (N) from the nozzle (27).

In a 43rd aspect according to anyone of the aspects from 37 to 42, the treatment composition (N) supplied by the treating station (10), comprises at least one of: a treatment liquid and a treatment foam.

In a 44th aspect according to anyone of the aspects from 37 to 43, the treatment composition (N) comprises:

at least one pH control agent, preferably selected among: sodium bicarbonate, sodium carbonate, ammonium sulfate, ammonium tartrate, and citric acid, and at least one hydrotropic agent, preferably selected between urea and thiourea.

In a 45th aspect according to anyone of the aspects from 37 to 44, the treating station (10) operates downstream said printing station (6), optionally at the operative tract (3) of the conveyor belt (2).

In a 46th aspect according to anyone of the aspects from 29 to 45, the control unit (9) is active on the conveyor belt (2) and on the plasma treating device (11), said control unit (9) being configured for:

commanding the movement of the conveyor belt (2), controlling at least one operative parameter of the plasma treating device (11) as a function of the movement imparted to the conveyor belt (2) and optionally, controlling a hydrophobicity increase of the sheet fibrous material (T).

In a 47th aspect according to anyone of the aspects from 29 to 46, the plant comprises at least one sensor capable of emitting a signal related to the motion of the conveyor belt (2), said control unit (9) being active on said conveyor belt (2) and on the plasma treating device (11), said control unit (9) being configured for:

receiving from said sensor a signal related to the movement of the conveyor belt (2), determining, as a function of said signal, a movement speed of the sheet fibrous material (T) along the advancement direction (A), as a function of the movement speed of the fibrous material (T), commanding the value of at least one operative parameter of the plasma treating device (11) selected among:

a potential difference between at least the first and second electrodes (11*a*, 11*b*) defined by the electric field generator, an intensity of the current passing in the circuit which puts in communication the generator and the electrodes;

a frequency of the current of the electric field generator;

the distance of the electrodes of the sheet fibrous material;

a dose parameter defined by a power per surface unit transmitted by an electric discharge supplied by the plasma treating device (11) of the sheet fibrous material (T) moving from the preparing station (4).

In a 48th aspect according to anyone of the aspects from 37 to 47, the control unit (9) is active on the treating station (10), said control unit (9) being configured for:

receiving a desired value of at least one operative parameter representative of a quantity of the treatment material, particularly a predetermined quantity of the treatment foam, applied on the sheet fibrous material by said treating station (1), said at least one operative parameter comprising at least one of the following:

a weight percentage per square meter variation of the sheet fibrous material between a section immediately upstream the second treating station (10), wherein the fibrous material has not received the treatment composition, and a section immediately downstream the treating station (10), wherein the fibrous material has received the treatment composition, a volume flow rate of the treatment composition exiting said treating station, a mass flow rate of the treatment composition exiting said treating station, commanding the second treating station (10) in order to manage the application of the treatment composition on the sheet fibrous material (T), as a function of the desired value of the operative parameter and of the movement imparted to said conveyor belt (2).

In a 49th aspect according to anyone of the aspects from 37 to 48, the treatment composition comprises a treatment foam, the plant (1) comprising at least one sensor capable of emitting a signal related to the motion of the conveyor belt (2), said control unit (9) being configured for:

receiving, from said sensor, a signal related to the movement of the conveyor belt (2), determining as a function of said signal, a movement speed of the sheet fibrous material (T) along the advancement direction (A), as a function of the movement speed of the fibrous material (T), commanding to supply the treatment foam for satisfying the desired value of said at least one operative parameter, optionally in order to satisfy the desired values of at least one of the following parameters:

the foam exhibits, immediately downstream the second treating station (4), a thickness less than 2 mm, the weight percentage per square meter variation of the sheet fibrous material, between a section immediately upstream the treating station (10), wherein the fibrous material has not received the foam, and a section immediately downstream the treating station (10), wherein the fibrous material has received the foam, is comprised between 10% and 50%.

In a 50th aspect according to anyone of the aspects from 43 to 49, the treatment foam supplied by the treating station (10), comprises:

a treatment liquid in a percentage comprised between 5% and 75% wt. with respect to the total weight of said foam, at least one foaming agent in a percentage comprised between 0.2% and 5%, preferably between 0.4% and 2% wt. with respect to the total weight of said foam, water in quantity needed to reach 100%.

In a 51st aspect according to anyone of the aspects from 43 to 50, the treatment foam is characterized by at least one of the following parameters:

a density comprised between 0.005 and 0.3 g/cm$^3$, an average diameter of the cells comprised between 0.05 and 0.5 mm, a mean life comprised between about 1 and 60 seconds, an expansion ratio comprised between 2:1 and 6:1.

In a 52nd aspect according to anyone of the aspects from 37 to 51, the treatment composition (N) comprises a treatment foam.

In a 53rd aspect according to anyone of the aspects from 43 to 52, the treating station (10) comprises an applicator (12) configured for applying on the second side (T2) of the sheet fibrous material (T) a quantity of the treatment foam exhibiting, immediately downstream the applicator, a thickness less than 2 mm, particularly less than 1.5 mm.

In a 54th aspect according to the preceding aspect, the applicator (12) comprises at least one among:

a spreading doctor blade placed transversally to the motion of the conveyor belt and spaced above the operative tract, a spray dispenser spaced above the operative tract, an applicator roll with an associated respective doctor blade for adjusting a thickness of the foam deposited on a lateral surface of the applicator roll, this latter being placed with the rotation axis transversal to motion of the conveyor belt and with the lateral surface spaced above the operative tract of the conveyor belt, a drum placed with the rotation axis transversal to the motion of the conveyor belt and with the lateral surface spaced above the operative tract of the conveyor belt, the drum exhibiting a hollow interior destined to receive a predetermined quantity of foam and being provided with a predetermined number of nozzles or slits for supplying the foam, a distributor (25) comprising a reservoir (26) configured for receiving the treatment material (M), the reservoir (26) exhibiting at least one dispensing nozzle (27) defining an outlet of the reservoir (26), the nozzle (27) extending transversally to the motion of the conveyor belt (2) along the whole width of this latter, the distributor (25) comprises one or more pushers, for example one or more toothed wheels, placed inside the reservoir and configured for supplying the treatment material (M) from the nozzle (27).

In a 55th aspect according to the aspect 53 or 54, the treating station (10) comprises at least one foam generator (13) configured for generating the treatment foam and supplying the applicator, continuously or at predetermined time intervals, with a predetermined quantity of the treatment foam.

In a 56th aspect according to anyone of the aspects from 43 to 55, the treating station (10) is configured for defining on the second side (T2) of the sheet fibrous material at least one of:

a continuous foam layer adapted to cover at least partially the second side (T2) of the sheet fibrous material (T), a plurality of discrete foam areas, such foam discrete areas defined on the second side (T2) of the sheet fibrous material (T) being completely surrounded by the fibrous material not covered by foam.

In a 57th aspect according to anyone of the aspects from 43 to 56, the treating station (10) is configured for placing, on the second side (T2) of the sheet fibrous material (T), a predetermined quantity of the treatment foam, said predetermined quantity of the treatment foam being selected so that the sheet fibrous material (T) itself exhibits a weight percentage per square meter variation, between a section immediately upstream the treating station (10), wherein the fibrous material has not received the foam and a section immediately downstream wherein the fibrous material has received said foam, comprised between 10% and 50%.

In a 58th aspect according to anyone of the aspects from 43 to 57, the treating station (10) is configured for placing, on the second side (T2) of the sheet fibrous material (T), a predetermined quantity of the treatment foam, said predetermined quantity of the treatment foam is selected so that the same sheet fibrous material (T) exhibits a weight percentage per square meter variation, between said section immediately upstream the treating station (10) and a section immediately upstream the printing station (6), comprised between 10% and 50%.

In a 59th aspect according to anyone of the aspects from 37 to 58, wherein:

the treating station (10) is placed upstream the printing station (6) with respect to the advancement direction (A) of the fibrous material, the treating station (10) being configured for supplying the treatment foam comprising at least one anti-migration agent; or wherein:

the treating station (10) is placed downstream the printing station (6) with respect to the advancement direction (A) of the fibrous material, the treating station being configured for supplying the treatment foam comprising at least one pH control agent and at least one hydrotropic agent; or wherein:

the treating station (10) comprises a first treating station placed upstream the printing station (6) with respect to the advancement direction (A) of the fibrous material, the first treating station being configured for dispensing the treatment foam comprising at least one anti-migration agent, and a second treating station placed downstream the printing station (6) with respect to the advancement direction (A) of the fibrous material, the second treating station being configured for dispensing the treatment foam comprising at least one pH control agent and at least one hydrotropic agent.

In a 60th aspect according to anyone of the aspects from 37 to 59, the treating station (10) operates at the conveyor belt (2) and is configured for placing the treatment foam on the second side (T2) of the fibrous material (T) placed on the operative tract (3) of the conveyor belt (2).

In a 61st aspect according to anyone of the aspects from 37 to 60, the printing plant (1) comprises at least one control unit (9) active on the conveyor belt (2) and on the treating station (10), said control unit (9) being configured for:

commanding the movement of the conveyor belt (2), receiving a desired value of at least one operative parameter representative of a quantity of the treatment foam applied on the sheet fibrous material, said at least one operative parameter comprising at least one of the following:

a weight percentage per square meter variation of the sheet fibrous material between a section immediately upstream the treating station (10), wherein the fibrous material has not received the foam, and a section immediately downstream the treating station (10), wherein the fibrous material has received the foam, a weight percentage per square meter variation of the sheet fibrous material between said section immediately upstream the treating station (10) and a section immediately upstream the printing station (6), a volume flow rate of the treatment foam exiting said treating station, a mass flow rate of the treatment foam exiting said treating station, a thickness of the foam at the section immediately downstream the treating station, commanding the treating station (10) in order to manage the application of the treatment foam on the sheet fibrous material (T), as a function of the desired value of the operative parameter and of the movement imparted to said conveyor belt.

In a 62nd aspect according to the preceding aspects, the printing plant (1) comprises at least one sensor capable of emitting a signal related to the motion of the conveyor belt, said control unit (9) being configured for:

receiving, from said sensor, a signal related to the movement of the conveyor belt (2), determining as a function of said signal, a movement speed of the sheet fibrous material (T) along the advancement direction (A), as a function of the movement speed of the fibrous material (T), commanding to supply the treatment foam for satisfying the desired value of said at least one operative parameter, optionally in order to satisfy the desired values of at least one of the following operative parameters:

the foam exhibits, immediately downstream the treating station (10), a thickness less than 2 mm, particularly less than 1.5 mm, the weight percentage per square meter variation of the sheet fibrous material, between a section immediately upstream the treating station (10), wherein the fibrous material has not received the foam, and a section immediately downstream the treating station (10), wherein the fibrous material has received the foam, is comprised between 10% and 50%, the weight percentage per square meter variation of the sheet fibrous material, between said section immediately upstream the treating station (10) and said section immediately upstream the printing station (6), is comprised between 10% and 50%.

In a 63rd aspect according to the aspect 61 or 62, the control unit (9) is configured for setting the movement speed of the conveyor belt (2) so that the travelling time of the sheet fibrous material (T), from the section immediately downstream the treating station (10) to the section immediately upstream the treating station (6), is less than 60 sec., particularly less than 30 sec., still more particularly in a time comprised between 0.5 and 20 sec.

In a 64th aspect according to anyone of the aspects from 61 to 63, the control unit (9) is configured for commanding the movement of the conveyor belt (2) for defining an operative condition wherein said conveyor belt (2) continuously moves along the advancement direction (A), the sheet fibrous material (T) at a speed constantly comprised between 20 and 100 m/min, particularly comprised between 30 and 70 m/min.

In a 65th aspect according to anyone of the preceding aspects, the printing station (6) comprises a printing module (7) configured for:

defining a print on the whole width of the sheet fibrous material (T), said width being measured normal to the advancement direction (A), staying in a fixed position and printing the second side (T2) of the sheet fibrous material (T) positioned on the operative tract (3).

In a 66th aspect according to anyone of the aspects from 43 to 65, the treatment foam comprises at least one treatment liquid in a quantity comprised between 5% and 75% wt. with respect to the total weight of the foam, said treatment liquid comprising:

at least one anti-migration agent, preferably selected among alginates, derivatives of the cellulose, particularly carboximethylcellulose, hydroxyethylcellulose, acrylic (co)polymers, xanthan gum, Arabic gum, and guar gum, and/or a fixing agent, particularly said fixing agent comprises at least one of:

at least one pH control agent, preferably selected among: sodium bicarbonate, sodium carbonate, ammonium sulfate, ammonium tartrate, and citric acid, and at least one hydrotropic agent, preferably selected between urea and thiourea, at least one foaming agent in a weight percentage comprised between 0.2% and 5%, preferably between 0.4% and 2%, with respect to the total weight of the foam, water in a quantity needed to reach 100%.

In a 67th aspect according to anyone of the preceding aspects, the printing plant (2) comprises:

at least one station (14) for supplying the sheet fibrous material (T), optionally comprising at least one roll of sheet material placed on a supplying drum, at least one drying station (16) placed in line downstream the printing station, and at least one station (17) for gathering the printed dried sheet fibrous material.

In a 68th aspect according to the preceding aspect, the treating station (10) is interposed in line between the supplying station and printing station and/or between the printing station and drying station so that the sheet material can advance without interruptions from the supplying station to the gathering station, by passing through the treating station/s, printing station and drying station.

In a 69th aspect according to anyone of the aspects from 6 to 68, the treatment composition (M), supplied by the preparing station (4), comprises at least one of:

at least one anti-migration agent, preferably selected among alginates, derivatives of the cellulose, particularly carboximethylcellulose, hydroxyethylcellulose, acrylic (co)polymers, xanthan gum, Arabic gum, and guar gum, and/or at least one pH control agent, preferably selected among: sodium bicarbonate, sodium carbonate, ammonium sulfate, ammonium tartrate, and citric acid, at least one hydrotropic agent, preferably selected between urea and thiourea, and optionally:

at least one surfactant and/or one neutral salt and/or one anti-reducing agent and/or one wetting agent and/or one anti-fermentation agent.

In a 70th aspect according to anyone of the aspects from 37 to 69, the treatment composition (N), supplied by the treating station (10), comprises at least one of:

at least one pH control agent, preferably selected among: sodium bicarbonate, sodium carbonate, ammonium sulfate, ammonium tartrate, and citric acid, at least one hydrotropic agent, preferably selected between urea and thiourea.

In a 71st aspect, it is provided a process of printing a sheet fibrous material, optionally using the plant of the preceding aspects, comprising the following steps:

moving the sheet fibrous material (T) along an advancement direction (A), placing a first side (T1) of the sheet fibrous material (T) in contact with an exposed surface of the conveyor belt (2) so that the same can define an operative tract wherein the conveyor belt (2) supports the fibrous material, ink-printing, particularly digitally printing, a second side (T2), opposite the first side (T1), of the sheet fibrous material (T) in contact with the conveyor belt (2).

In a 72nd aspect according to the preceding aspect, the process comprises, before the printing step, a step of preparing at least part of a side of the fibrous material, by placing on the material itself a predetermined quantity of the treatment composition (M), particularly, the preparing step comprises placing the composition on the second side (T2) opposite the first side (T1), of the sheet fibrous material (T) optionally in contact with the conveyor belt (2), and moving along the advancement direction (A).

In a 73rd aspect according to the preceding aspect, the weight percentage per square meter variation of the sheet fibrous material (T), between immediately before and immediately after the preparing step, is comprised between 10% and 50%.

In a 74th aspect according to the aspect 72 or 73, the weight percentage per square meter variation of the sheet fibrous material (T), between immediately before the preparing step and immediately before the printing step, is comprised between 10% and 50%, particularly the weight percentage per square meter variation of the sheet fibrous material (T), between immediately after the preparing step and immediately before the printing step, is comprised between 0% and 10%.

In a 75th aspect according to anyone of the aspects from 72 to 74, moving a point of the sheet fibrous material (T), between a section immediately after the preparing step and a section immediately before the printing step, is performed in a time less than 60 sec, particularly in a time less than 30 sec, still more particularly in a time comprised between 0.5 and 20 sec.

In a 76th aspect according to anyone of the aspects from 71 to 75, wherein the printing step is performed in a printing station (6) adapted to ink-print, particularly to digitally print, the sheet fibrous material (T), the printing station (6) comprising a printing module (7) which, during the movement of the sheet fibrous material (T), stays in a fixed position and prints on the whole width of the sheet fibrous material (T).

In a 77th aspect according to the aspect 71 or 75 or 76, the process comprises:

before the ink-printing step, at least one step of preparing the sheet fibrous material (T), configured for modifying the surface hydrophobicity of at least part of the sheet fibrous material, following the preparing step, performing a treating step distinct and separated from the preparing step, said treating step providing to apply a predetermined quantity of the treatment composition (N) on at least part of the second side (T2) comprising at least one of: a pH control agent and a hydrotropic agent.

In a 78th aspect according to the preceding aspect, the preparing step provides a plasma treatment defining a treating environment wherein at least one portion of the sheet fibrous material (T) is received, wherein is present an ionized gas.

In a 79th aspect according to the preceding aspect, the plasma treatment generates plasma in said treating environment by using one or more of the following gases: air, nitrogen, nitrogen oxide (NO), ammonia, inert gases such as for example argon and helium, oxygen, hydrogen, carbon dioxide ($CO_2$), fluorinated gases such as for example $SF_6$ and $SOF_6$, hydrocarbon gases such as for example methane and ethane, fluorocarbon gases such as for example $CF_4$ and $C_2F_6$, alone or in a mixture, preferably nitrogen, still more preferably 2 $l_n$/min nitrogen;

optionally, the plasma-treating step generates plasma in the treating environment by using one or more of said gases mixed with one or more of: water vapour, hexamethyldisiloxane vapours of ammonium (HMDSO), and vapours of other silanes, siloxanes, hydrocarbons and perfluorinated compounds.

In an 80th aspect according to the aspect 78 or 79, the plasma treatment is performed on the sheet fibrous material (T) before the material (T) itself contacts the conveyor belt (2), particularly the preparing step is performed immediately before the printing of the sheet fibrous material (T).

In an 81st aspect according to anyone of the aspects from 77 to 80, the treatment composition (N) supplied during the treating step comprises at least one of: a treatment liquid and a treatment foam, said treatment composition (N) comprising at least one of:

at least one pH control agent, preferably selected among sodium bicarbonate, sodium carbonate, ammonium sulfate, ammonium tartrate, and citric acid, and a hydrotropic agent, preferably selected between urea and thiourea.

In an 82nd aspect according to anyone of the aspects from 77 to 81, the treating step is performed on the sheet fibrous material (T) in contact with the conveyor belt (2), particularly after the printing step.

In an 83rd aspect according to anyone of the aspects from 77 to 82, the treating step provides to deposit the treatment composition (N) by one or more of the following methods:

coating by a doctor blade placed transversally to the motion of the conveyor belt and spaced above the operative tract, spray dispensing at a distance above the operative tract, coating by an applicator roll with an associated respective doctor blade for adjusting a thickness of the treatment composition deposited on a lateral surface of the applicator roll, this latter being placed with the rotation axis transversal to the motion of the conveyor belt and with the lateral surface spaced above the operative tract of the conveyor belt, dispensing by a drum (23) placed with the rotation axis transversal to the motion of the conveyor belt and with the lateral surface spaced above the operative tract of the conveyor belt, the drum exhibiting a hollow interior destined to receive a predetermined quantity of the treatment composition (N) and being provided with a predetermined number of nozzles or slits for dispensing the foam, coating by a distributor (25) exhibiting a dispensing nozzle extending transversally to the motion of the conveyor belt and configured for contacting the sheet fibrous material (T).

In an 84th aspect according to anyone of the aspects from 78 to 83, the process comprises the following steps:

commanding the movement of conveyor belt (2), controlling at least one operative parameter of the plasma treatment as a function of the movement imparted to the conveyor belt (2).

In an 85th aspect according to the preceding aspect, the process comprises the following steps:

receiving, from a sensor, a signal related to the movement of the conveyor belt (2), determining, as a function of said signal, a movement speed of the sheet fibrous material (T) along the advancement direction (A), as a function of the movement speed of the fibrous material (T), commanding the value of at least one operative parameter of the plasma treatment selected among:

a potential difference between at least one first and one second electrodes (11*a*, 11*b*), defined by an electrical field generator;

an intensity of the current in the circuit which puts in communication the generator and the electrodes;

a frequency of the current of the electric field generator;

a distance between the electrodes of the sheet fibrous material;

a parameter of a dose defined by a power per surface unit transmitted by an electric discharge supplied by the plasma treating device (11) of the sheet fibrous material (T) moving from the preparing station (4).

In an 86th aspect according to the aspect 84 or 85, the process comprises the following steps:

detecting a desired value of at least one operative parameter representative of a quantity of a treatment material, particularly a predetermined quantity of the treatment foam, applied on the sheet fibrous material during the treating step, said at least one operative parameter comprising at least one of the following:

a weight percentage per square meter variation of the sheet fibrous material immediately before the second treating step, wherein the fibrous material has not received the treatment composition, and immediately after the second treating step, wherein the fibrous material (T) has received the treatment composition (T), a volume flow rate of the treatment composition immediately after the second treating step, a mass flow rate of the treatment composition immediately after the second treating step, managing the application of the treating composition on the sheet fibrous material (T), as a function of the desired value of the operative parameter and of the movement imparted to said conveyor belt (2).

In an 87th aspect according to anyone of the aspects from 81 to 86, the treatment composition comprises a treatment foam, the process comprising the following steps:

receiving, from a sensor, a signal related to the movement of the conveyor belt (2), determining, as a function of said signal, the movement speed of the sheet fibrous material (T) along the advancement direction (A), as a function of the movement speed of the fibrous material (T), commanding to dispense the treatment foam for satisfying the desired value of said at least one operative parameter, optionally in order to satisfy the desired values of at least one of the following operative parameters:

the foam exhibits, immediately after the second treating step, a thickness less than 2 mm, the weight percentage per square meter variation of the sheet fibrous material, immediately before the second treating step, wherein the fibrous material has not received the foam, and immediately after the second treating step, wherein the fibrous material has received the foam, is comprised between 10% and 50%.

In an 88th aspect according to anyone of the aspects from 71 to 87, the movement of the sheet fibrous material (T) along the advancement direction (A) occurs continuously at a speed constantly comprised between 20 and 100 m/min, particularly comprised between 30 and 70 m/min.

In an 89th aspect according to anyone of the aspects from 71 to 88, the printing step is performed in a printing station (6) adapted to ink-print, particularly to digitally print, the sheet fibrous material (T), the printing station (6) comprising a printing module (7) which, during the movement of the sheet fibrous material, stays in a fixed position and prints on the whole width of the sheet fibrous material (T).

In a 90th aspect according to anyone of the aspects from 71 to 89, the process comprises the following steps:

unwinding the sheet fibrous material (T) from at least one supplying station, optionally comprising at least a roll of sheet material placed on a supplying drum, drying the sheet fibrous material (T) after the printing step, particularly after the second treating step, gathering the printed dried sheet fibrous material (T).

In a 91st aspect according to anyone of the aspects from 71 to 90, the process comprises at least one step of treating the sheet fibrous material, which comprises applying on the second side (T2) of the sheet fibrous material (T) a treatment foam comprising at least one of:

an anti-migration agent, a pH control agent and a hydrotropic agent.

In a 92nd aspect according to the preceding aspect, the treating step comprises the following sub-steps:

generating a predetermined quantity of the treatment foam, supplying the treatment foam to an applicator, placing, by the applicator, a treatment foam on the second side (T2) of the sheet fibrous material (T).

In a 93rd aspect according to the preceding aspect, the step of placing the foam being performed by one or more of the following:

an application by a spreading doctor blade placed transversally to the motion of the conveyor belt and spaced above the operative tract, an application with a spray dispenser spaced above the operative tract, an application by an applicator roll having an associated respective doctor blade for adjusting a thickness of the foam deposited on a lateral surface of the applicator roll, this latter being placed with the rotation axis transversal to the motion of the conveyor belt and with the lateral surface spaced above the operative tract of the conveyor belt, an application by a drum placed with the rotation axis transversal to the motion of the conveyor belt and with a lateral surface spaced above the operative tract of the conveyor belt, the drum exhibiting a hollow interior destined to receive a predetermined quantity of foam and being provided with a predetermined number of nozzles or slits for dispensing the foam, an application by a distributor (25) comprising a reservoir (26) configured for receiving the treatment material (M), the reservoir (26) exhibiting at least one dispensing nozzle (27) defining an outlet of the reservoir (26), the nozzle (27) extending transversally to the motion of the conveyor belt (2) along the whole width of this latter, the distributor (25) comprises one or more pushers, for example one or more toothed wheels, placed inside the reservoir and configured for dispensing the treatment material (M) from the nozzle (27).

In a 94th aspect according to anyone of the aspects from 91 to 93, the treating step places on the second side of the sheet fibrous material (T) a quantity of the treatment foam exhibiting, immediately after the application step, a thickness less than 2 mm, particularly less than 1.5 mm.

In a 95th aspect according to anyone of the aspects from 91 to 94, the treatment step places, on the second side (T2) of the sheet fibrous material (T), a predetermined quantity of the treatment foam, said quantity of the treatment foam being selected so that the sheet fibrous material (T) itself exhibits a weight percentage per square meter variation, immediately before and immediately after said treating step, comprised between 10% and 50%.

In a 96th aspect according to anyone of the aspects from 91 to 95, the treating step is performed before the printing step, particularly the sheet fibrous material is not subjected to further operations between the treating step and the printing step.

In a 97th aspect according to anyone of the aspects from 91 to 96, the movement provides to continuously displace the sheet fibrous material (T) at a speed constantly greater than 0, particularly constantly comprised between 20 and 100 m/min, still more particularly comprised between 30 and 70 m/min.

In a 98th aspect according to the preceding aspect, the steps of treating and printing the sheet fibrous material (T) are performed in line during the continuous movement of the sheet fibrous material (T).

In a 99th aspect according to anyone of the aspects from 91 to 98, the process comprises the following steps:

moving the conveyor belt (2), detecting a desired value of at least one operative parameter representative of a quantity of the treatment foam applied on the sheet fibrous material, said at least one operative parameter comprising at least of the following:

a weight percentage per square meter variation of the sheet fibrous material immediately before the treating step, wherein the fibrous material has not received the foam, and immediately after the treating step, wherein the fibrous material itself has received the treatment composition, a weight percentage per square meter variation of the sheet fibrous material immediately after the treating step and immediately before the treating step, a volume flow rate of the treatment foam immediately after the treating step, a mass flow rate of the treatment foam immediately after the treating step, a thickness of the foam immediately after the treating step, commanding to dispense the treatment foam on the sheet fibrous material (T), as a function of the desired value of the operative parameter and of the movement imparted to said conveyor belt (2).

In a 100th aspect according to the preceding aspect, the process comprises the following steps:

comprising the following steps:

emitting, particularly by a sensor, a signal related to the motion of the conveyor belt, receiving the signal related to the movement of the conveyor belt (2), determining, as a function of said signal, the movement speed of the sheet fibrous material (T) along the advancement direction (A), as a function of the movement speed of the fibrous material (T), commanding to dispense the treatment foam for satisfying the desired value of said at least one operative parameter, optionally in order to satisfy the desired values of at least one of the following operative parameters:

the foam exhibits, immediately after the treating step, a thickness less than 2 mm, particularly less than 1.5 mm, the weight percentage per square meter variation of the sheet fibrous material, between a section immediately after the treating step, wherein the fibrous material has not received the foam, and immediately before the treating step, wherein the fibrous material has received the foam, is comprised between 10% and 50%, the weight percentage per square meter variation of the sheet fibrous material, between said section immediately before the treating step and said section immediately before the printing step, is comprised between 10% and 50%.

In a 101st aspect according to anyone of the aspects from 91 to 100, the process comprises a step of setting the movement speed of the conveyor belt (2) so that the travelling time of a section of the sheet fibrous material (T), exiting the treating step and entering the printing step, is less than 60 sec, particularly less than 30 sec, still more particularly in a range comprised between 0.5 and 20 sec.

In a 102nd aspect according to anyone of the aspects from 91 to 101, the treatment foam comprises at least one treatment liquid in a quantity comprised between 5% and 75% wt. with respect to the total weight of the foam, said treatment liquid comprising:

at least one anti-migration agent, preferably selected among: alginates, derivatives of the cellulose, particularly carboximethylcellulose, hydroxyethylcellulose, acrylic (co)polymers, xanthan gum, Arabic gum, and guar gum, and/or at least one pH control agent, preferably selected among: sodium bicarbonate, sodium carbonate, ammonium sulfate, ammonium tartrate, and citric acid, and at least one hydrotropic agent, preferably selected between urea and thiourea, a foaming agent in a weight percentage comprised between 0.2% and 5%, preferably between 0.4% and 2%, with respect to the total weight of the foam, water in a quantity needed to reach 100%.

BRIEF DESCRIPTION OF THE DRAWINGS

Some embodiments and some aspects of the invention will be described in the following with reference to the accompanying drawings given only in an indicative and therefore non limiting way, wherein:

FIGS. from 1 to 4 are respective outlines of printing plants according to the present invention;

Figure 12:
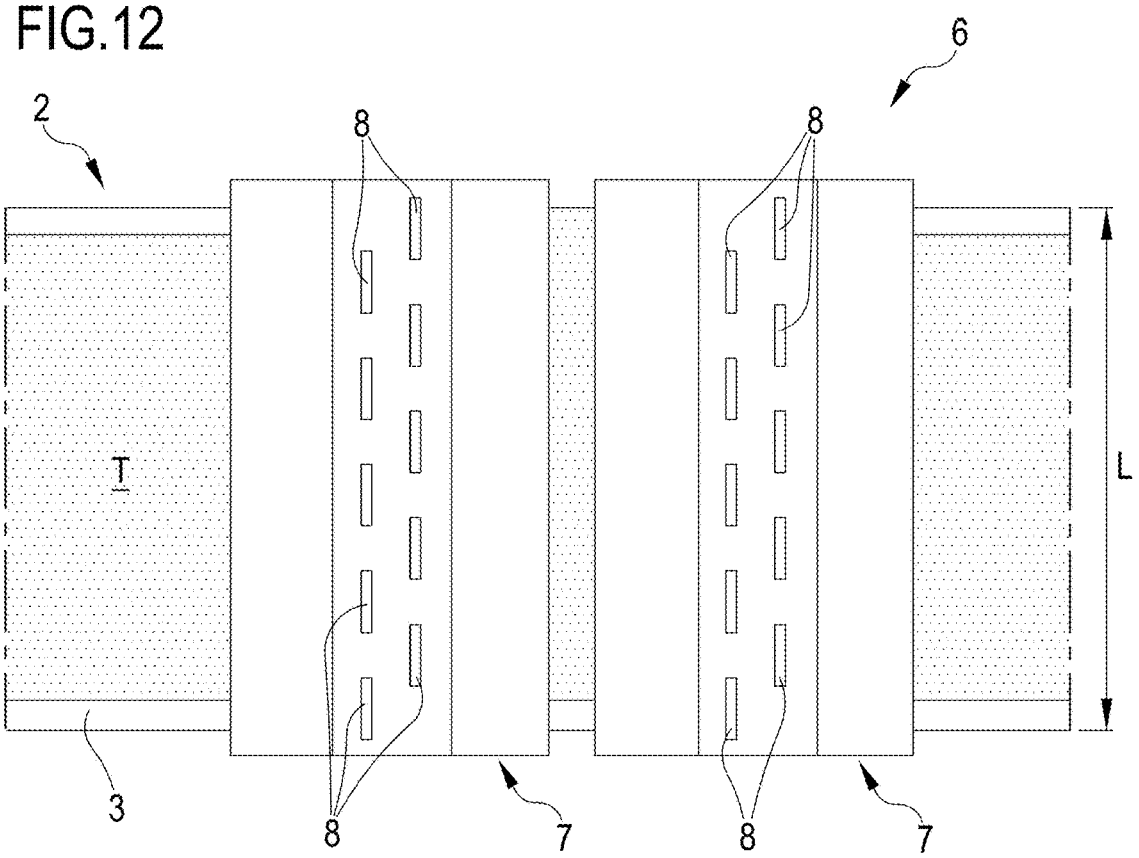
Figure 13:
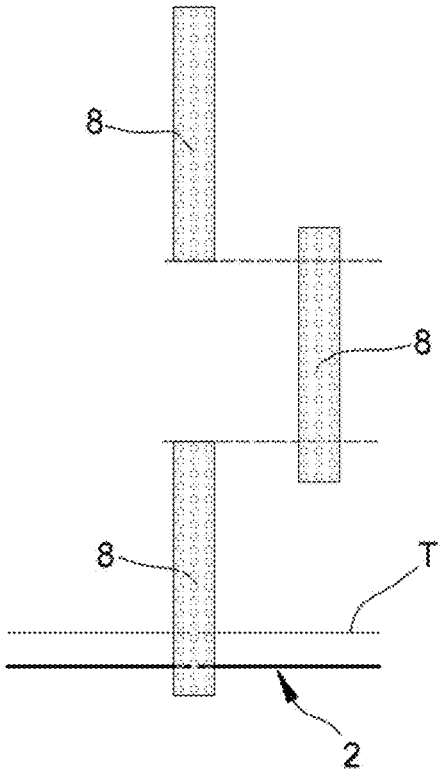
Figure 14:
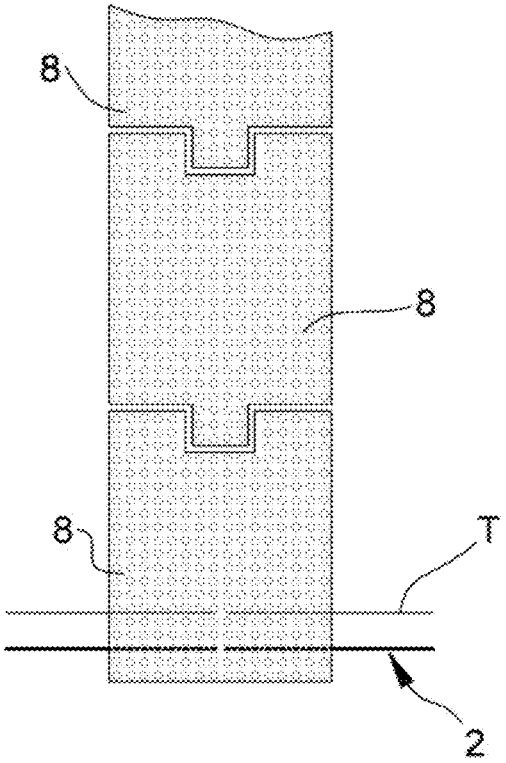

FIGS. from 5 to 9 are respective outlines regarding preparing and/or treating stations of the printing plant according to the present invention;

FIG. 10 is a perspective view of a further treating plant according to the present invention;

FIG. 11 is a detailed view of a preparing and/or treating stations of the printing plant according to the present invention;

FIG. 12 is an outline, according to a top plan view, of a digital printing station of a plant according to the present invention;

FIG. 13 is a detailed view of the printing station in FIG. 12;

FIG. 14 is an outline of an embodiment variant of the printing head for a plant according to the present invention.

DEFINITIONS AND MATERIALS

The figures could illustrate the object of the invention by not-in-scale representations, therefore, parts and components illustrated in the figures regarding the object of the invention, could only indicate schematic representations.

In the following description and in the attached claims, the terms hereinbelow listed, take the meaning specified in the following.

Ink: a mixture formed by a dispersion of pigments or by a solution of dies in an aqueous or organic medium destined to be transferred on surfaces of different materials for obtaining one or more prints, for example by digital printing; transparent inks and paints are also comprised. For example, the term ink can be understood as an ink comprising at least one of: a water-based acid ink, a reactive ink, a dispersed ink, a pigment ink, a solvent-based dispersed ink, and a dispersed reactive ink.

The ink for this type of printing can exhibit a viscosity comprised in the range from 1 to 10 mPa*s, preferably from 4 to 8 mPa*s, more preferably about 6 mPa*s measured according to the ASTM D7867-13 standard.

Moreover, the ink can exhibit a surface tension comprised in the range from 25 to 45 mN/m, preferably from 30 to 40 mN/m, more preferably about 35 mN/m, measured according to the ASTM D1331-14 method. The viscosity and surface tension were measured at a temperature of 20° C. and at the atmospheric pressure. Further, the operative temperature is comprised in the range between 15° C. and 45° C., preferably between 30° C. and 40° C.; the operative temperature is understood as the temperature of the ink inside a printing head.

A person skilled in the art is capable of selecting the type of ink and also the application conditions and the additives suitable for this type of printing and as a function of the type of fibrous material to be printed.

Fibrous material: a material made of fibers of different type—for example fabric, non-woven fabric, knitted fabric or combinations of one or more of the cited supports. Specifically, the fiber of said fibrous material can be derived from a natural, vegetal or animal, artificial or synthetic source, for example can be a fiber of cotton, flax, manila hemp, jute, wool, viscose or artificial silk, acrylic, polyamide (nylon), polyester, polypropylene, polyethylene, chlorovinyl, polyurethane (Elastam), Teflon (Gore-tex), aramid fibers (Kevlar) or mixtures thereof.

Sheet fibrous material: a fibrous material as hereinbefore defined formed by a structure having two dimensions (length and width) having dimensions substantially prevailing with respect to a third dimension (thickness). The term sheet fibrous material means both a fibrous material consisting of discrete sheets having a limited length (for example the formats A0, A1, A2, A3, A4, etc.) and continuous webs exhibiting a marked length, which can be supplied by a roll on which the sheet material is wound, or can come from an in-line printing step. In any case, the sheet fibrous material, herein described, exhibits two sides or main surfaces, on at least one of which it is provided a print.

Hydrophilic material: a material capable of absorbing and/or retaining water.

Digital printing: printing using one or more nozzle printing heads for applying inks defining motives, patterns, colorations, etc., on sheet materials. The printing heads can be movable transversally to the sheet material advancement direction in order to cover the overall width to be printed, or can be transversally stationary, when the heads width is equal to the printing width, in other words the fabric.

Treatment composition: a composition in the form of a treatment liquid or a treatment foam. The treatment composition comprises one or more liquid compounds, or one or more solid compounds dissolved or dispersed in a suitable liquid phase, having the function of preparing and/or treating at least the surface or surfaces of the sheet fibrous material destined to receive one or more prints. The compound/s can be derived from a natural and/or synthetic (polymers and/or copolymers) sources and can act as one or more of the following: anti-migration agent, thickener, surface tension modifier, acidity modifier, hydrophilicity modifier, hydrophobicity modifier, drying accelerator, a fixation improver. The liquid phase can be aqueous, organic, polymeric or mixed.

Treatment liquid: comprises:

at least one anti-migration agent configured for limiting the diffusion of the ink in the fiber of the sheet fibrous material. Such anti-migration agent can for example comprise water-soluble polymers, in other words polymers having a solubility greater than 1%, preferably equal to or greater than 10% of the mass in an aqueous or alkaline solution at 25° C. Particularly, the anti-migration agent can comprise: (sodium, potassium or calcium, preferably sodium) alginates, derivatives of the cellulose, particularly carboxymethylcellulose, hydroxyethylcellulose, acrylic (co)polymers, xanthan gum, Arabic gum, guar gam and similar; or:

at least one pH control agent (buffering agents). Specifically, the buffering agent can comprise $NaHCO_3$ (adapted in case of materials of cotton printed with reactive colorant ink for maintaining the alkalinity, for example), a weak acid (for example tartaric acid ammonium for controlling the pH, advantageously but in a non-limiting way used in case of silk and similar materials printed with acid colourant ink), and inert organic acid (for example, citric acid, for controlling the pH in case of polyester-based materials and similar printed with a dispersed colourant ink); and at least one hydrotropic agent configured for increasing the moisture contents of the fiber or for increasing the solubility of the colourant. Hydrotropic agents are known to the person skilled in the art and are: urea, thiourea and similar.

Optionally, the treatment liquid can comprise one or more of the following agents:

a surfactant agent configured for increasing the colourant permeability in the fiber. Some surfactants have also the function of anti-migration agents. Such surfactants can comprise non-ionic, anionic surfactants and similar;

an anti-diffusion agent configured for stopping the ink on the sheet fibrous material and/or increasing the colour development properties. The anti-diffusion agent can for example comprise silica, alumina, cationic agents and similar. The silica can be used in a silica sol form, in other words as a dispersion.

Other conditioners, such as for example neutral salts, anti-reducing agents, humectants, anti-fermentation agents, and similar.

The neutral salts have the function of accelerating the depletion of the colourant and are mainly applied to the cotton fibers. Such suitable neutral salts are known to the person skilled in the art and include, for example, sodium chloride, sodium sulfate, and similar.

The anti-reducing agent is a substance which prevents the reduction of the colourant and therefore prevents a decrease of the colourant concentration. Suitable anti-reducing agents are known to the person skilled in the art and include, for example, meta-nitro benzene sulfonic acid and similar.

The humectants have the function of moisturizing the fibrous material so that it can be adapted to the ink jet head, and further have the function of controlling the viscosity. Suitable humectants comprise, for example: ethylene glycole, propylene glycole, and similar.

The anti-fermentation agents instead can comprise 2'-dihydroxi-5,5'-dichlorodiphenylmethane.

The treatment liquid can be prepared by mixing one or more of the components by conventional methods. As an alternative, individual liquid compositions such as for example: a liquid composition containing an anti-migration agent, a liquid composition containing an anti-diffusion agent, a liquid composition containing a pH control agent for an acid colourant ink, a liquid composition containing a pH control agent for a dispersed colourant ink, a liquid composition containing a pH control agent for a reactive colourant ink, a liquid composition containing a hydrotropic agent, a liquid composition containing a surfactant, or a similar liquid composition containing a neutral salt, and/or an anti-reducing agent and similar can be prepared. As an alternative, each individual composition can be applied alone to such fibrous material. Both the individual liquid compositions and the treatment liquid are filtered by a membrane, for example an acetate or cellulose nitrate membrane.

As an alternative, the treatment liquid can be prepared by suitably diluting a concentrated treatment composition, comprising at least one anti-migration agent, a pH control agent, a hydrotropic agent and, optionally, one or more of the other components as hereinbefore defined. The concentrated composition can be in the form of a paste, preferably having a viscosity of about 300-500 cP measured according to the Brookfield method.

The treatment liquid, according to the invention, generally has a viscosity greater than 2.0 cP, preferably greater than 5 cP, particularly comprised between 10 and 20 cP. Such viscosity is measured by a DV-II+Viscometer instrument (Brookfield Inc.). Generally, the treatment liquid has a surface tension greater than 20 $N/cm^2$, preferably greater than 25 $N/cm^2$, greater than 30 $N/cm^2$; and/or greater than 70 $N/cm^2$, less than 65 $N/cm^2$, less than 60 $N/cm^2$. Generally, such treatment liquid has a surface tension comprised in the range from 20 to 70 $N/cm^2$. Such surface tension is measured by a Surface Tensiomat 21 instrument (Fisher Scientific Inc.).

The viscosity and surface tension were measured at a temperature of 20° C. and at the atmospheric pressure.

In a general formulation of the treatment liquid, the same comprises at least one of:

at least one anti-migration agent, preferably selected among: alginates, derivatives of the cellulose, particularly carboximethylcellulose, hydroxyethylcellulose, acrylic (co)polymers, xanthan gum, Arabic gum, and guar gum;

at least one pH control agent, preferably selected among sodium bicarbonate, sodium carbonate, ammonium sulfate, ammonium tartrate, and citric acid, at least one hydrotropic agent, preferably selected between urea and thiourea.

Optionally, the treatment liquid comprises:

at least one anti-migration agent, preferably selected among: alginates, derivatives of the cellulose, such as carboximethylcellulose, hydroxyethylcellulose, acrylic (co)polymers, xanthan gum, Arabic gum, and guar gum; and/or at least one pH control agent, preferably selected among: sodium bicarbonate, sodium carbonate, ammonium sulfate, ammonium tartrate, and citric acid, and at least one hydrotropic agent, preferably selected between urea and thiourea.

Optionally, the treatment liquid can further comprise at least one surfactant and/or a neutral salt and/or an anti-reducing agent and/or one humectant and/or one anti-fermentation agent.

In a first embodiment, the treatment liquid can comprise:

sodium alginate, preferably in a percentage comprised between 0.1% and 1% wt. with respect to the total weight of the composition, and an acrylic (co)polymer, more preferably, Thermacol MP, preferably in a percentage comprised between 8% and 12% wt. with respect to the total weight of the composition, and water in a quantity needed to reach 100%.

In an embodiment variant of the first embodiment of the treatment liquid, this latter can comprise:

an acrylic (co)polymer, preferably in a percentage comprised between 10% and 20% wt., and optionally guar gam, preferably in a percentage comprised between 0.1% and 1% wt. with respect to the total weight of the composition, water in a quantity needed to reach 100%.

In an embodiment variant of the first embodiment, the treatment liquid can comprise:

an anti-migration agent, for example hydroxyethylcellulose, preferably in a percentage comprised between 3% and 7% wt. with respect to the total weight of the composition, a surfactant, for example FLUORAD FC170, preferably in a percentage comprised between 0.1% and 0.5% wt. with respect to the total weight of the composition, a humectant, for example glycerine, preferably in a percentage comprised between 1% and 4% wt. with respect to the total weight of the composition, and water in a quantity needed to reach 100%.

The above described treatment liquid does not comprise both pH control agents and hydrotropic agents. The treatment liquid, defined in the second embodiment, is suitable for interacting with a dispersed ink which does not require both to use pH control agents and hydrotropic agents; further such treatment liquid enables to apply the anti-migration agent separately from the pH control agent and from the hydrotropic agent when reactive or acid ink is used.

In a second embodiment, the treatment liquid can comprise:

sodium bicarbonate and/or sodium carbonate, in a percentage comprised between 2.5% and 3% wt. with respect to the total weight of the composition, urea, preferably in a percentage comprised between 6% and 18% wt. with respect to the total weight of the composition, and water in a quantity needed to reach 100%.

In an embodiment variant of the second embodiment of the treatment liquid, this latter can comprise:

ammonium sulfate (solution 1:2) or ammonium tartrate, preferably in a percentage comprised between 4% and 8% wt. with respect to the total weight of the composition, urea, preferably in a percentage comprised between 6% and 15% wt. with respect to the total weight of the composition, and water in a quantity needed to reach 100%.

The treatment liquid defined in the second embodiment does not comprise anti-migration agents and is adapted to interact with pigment inks, which do not require to use anti-migration agents.

Moreover, as an individual composition, the above define treatment liquid enables to apply the pH control and hydrotropic agents separately from the anti-migration agent when a reactive or acid ink is used.

In a third embodiment, the treatment liquid can comprise:

at least one anti-migration agent, preferably selected between alginates, acrylic (co)polymers and guar gam, at least one pH control agent, preferably selected among sodium bicarbonate, sodium carbonate, ammonium sulfate and ammonium tartrate, at least one hydrotropic agent preferably urea.

Preferably, according to the third embodiment, the treatment liquid, for example adapted to interact with reactive inks, can comprise:

alginate, preferably in a percentage comprised between 0.1% and 1% wt. with respect to the total weight of the composition, and an acrylic (co)polymer, preferably Thermacol MP, preferably in a percentage comprised between 8% and 12% wt. with respect to the total weight of the composition, sodium bicarbonate and/or sodium carbonate, preferably in a percentage comprised between 2.5% and 3% wt. with respect to the total weight of the composition, urea, preferably in a percentage comprised between 6% and 18% wt. with respect to the total weight of the composition, an anti-reducing agent, preferably sodium salt of the 3-nitro benzene sulfonic acid (Lyoprint RG) preferably in a percentage comprised between 0.5% and 1% wt. with respect to the total weight of the composition, and water in a quantity needed to reach 100%.

Preferably, according to the third embodiment, the treatment liquid, for example adapted to interact with an acid ink, can comprise:

an acrylic (co)polymer, preferably Thermacol MP, preferably in a percentage comprised between 10% and 20% wt., and optionally guar gam, preferably in a percentage comprised between 0.1% and 1% wt. with respect to the total weight of the composition, ammonium sulfate or ammonium tartrate, preferably in a percentage comprised between 4% and 8% wt. with respect to the total weight of the composition, urea, preferably in a percentage comprised between 6% and 15% wt. with respect to the total weight of the composition, and optionally:

an anti-fermentation agent, preferably 2,2'-dihydroxy-5, 5'-dichlorodiphenylmethane (Prevental), preferably in a percentage comprised between 0.01% and 0.15% wt. with respect to the total weight of the composition, and water in a quantity needed to reach 100%.

Another example of a treatment liquid according to the third embodiment comprises:

at least one anti-migration agent, preferably selected between carboxymethylcellulose and hydroxyethylcellulose, at least one pH control agent, preferably selected among sodium carbonate, ammonium tartrate, and citric acid, at least one hydrotropic agent, preferably urea, at least one surfactant, preferably a non ionic surfactant, more preferably Triton X100 and at least one humectant, preferably glycerine.

Another example of the treatment liquid according to the third embodiment comprises:

carboxymethylcellulose, preferably in a percentage comprised between 1% and 3% wt. with respect to the total weight of the composition, sodium bicarbonate, preferably in a percentage comprised between 3% and 7% wt. with respect to the total weight of the composition, urea, preferably in a percentage comprised between 3% and 7% wt. with respect to the total weight of the composition, Triton X100, preferably in a percentage comprised between 3% and 7% wt. with respect to the total weight of the composition, and glycerine, preferably in a percentage comprised between 3% and 7% wt. with respect to the total weight of the composition, and water in a quantity needed to reach 100%.

The above defined treatment liquid is advantageously adapted to interact with reactive inks.

Another example of a treatment liquid according to the third embodiment comprises:

hydroxyethylcellulose, preferably in a percentage comprised between 1.5% and 4% wt. with respect to the total weight of the composition, ammonium tartrate, preferably in a percentage comprised between 1.5% and 4% wt. with respect to the total weight of the composition, urea, preferably in a percentage comprised between 3% and 7% wt. with respect to the total weight of the composition, Triton X100, preferably in a percentage comprised between 0.1% and 1% wt. with respect to the total weight of the composition, and glycerine, preferably in a percentage comprised between 3% and 7% wt. with respect to the total weight of the composition, and water in a quantity needed to reach 100%.

The above defined treatment liquid is advantageously adapted to interact with an acid colourant ink.

Another example of the treatment liquid according to the third embodiment comprises:

carboxymethylcellulose, preferably in a percentage comprised between 0.5% and 3% wt. with respect to the total weight of the composition, citric acid, preferably in a percentage comprised between 0.05% and 1% wt. with respect to the total weight of the composition, urea, preferably in a percentage comprised between 3% and 7% wt. with respect to the total weight of the composition, Triton X100, preferably in a percentage comprised between 0.1% and 1% wt. with respect to the total weight of the composition, and glycerine, preferably in a percentage comprised between 3% and 7% wt. with respect to the total weight of the composition, and water in a quantity needed to reach 100%.

The above defined treatment liquid is advantageously, but in a non-limiting way, adapted to interact with a dispersed ink.

Examples of individual compositions useable in the present invention, are:

In a first embodiment variant, an individual composition can comprise:

a hydrotropic agent, for example urea, preferably in a percentage comprised between 3% and 7% wt. with respect to the total weight of the composition, a surfactant, FLUORAD FC170 for example, preferably in a percentage comprised between 0.1% and 0.5% wt. with respect to the total weight of the composition, a humectant, for example glycerine, preferably in a percentage comprised between 1% and 4% wt. with respect to the total weight of the composition, and water in a quantity needed to reach 100%.

In a further embodiment variant, an individual composition can comprise:

sodium bicarbonate, preferably in a percentage comprised between 3% and 7% wt. with respect to the total weight of the composition, a surfactant, FLUORAD FC170 for example, preferably in a percentage comprised between 0.1% and 0.5% wt. with respect to the total weight of the composition, a humectant, for example glycerine, preferably in a percentage comprised between 1% and 4% wt. with respect to the total weight of the composition, and water in a quantity needed to reach 100%.

This latter defined individual liquid composition is advantageously, but in a non-limiting way, adapted to interact with reactive colourant inks.

In a further embodiment variant, an individual composition can comprise:

ammonium tartrate or ammonium sulfate, preferably in a percentage comprised between 3% and 7% wt. with respect to the total weight of the composition, a surfactant, FLUORAD FC170 for example, preferably in a percentage comprised between 0.1% and 0.5% wt. with respect to the total weight of the composition, a humectant, for example glycerine, preferably in a percentage comprised between 1% and 4% wt. with respect to the total weight of the composition, and water in a quantity needed to reach 100%.

The above defined individual liquid composition is advantageously, but in a non-limiting way, adapted to interact with acid colourant inks.

In a further embodiment variant, an individual composition can comprise:

citric acid, preferably in a percentage comprised between 3% and 7% wt. with respect to the total weight of the composition, a surfactant, FLUORAD FC170 for example, preferably in a percentage comprised between 0.1% and 0.5% wt. with respect to the total weight of the composition, a humectant, for example glycerine, preferably in a percentage comprised between 1% and 4% wt. with respect to the total weight of the composition, and water in a quantity needed to reach 100%.

The above defined individual liquid composition is advantageously, but in a non-limiting way, adapted to interact with dispersed colourant inks.

In a further embodiment variant, an individual composition can comprise:

- a surfactant, Triton X-705 for example, preferably in a percentage comprised between 3% and 7% wt. with respect to the total weight of the composition,
- a surfactant, FLUORAD FC170 for example, preferably in a percentage comprised between 0.1% and 0.5% wt. with respect to the total weight of the composition,
- a humectant, glycerine for example, preferably in a percentage comprised between 1% and 4% wt. with respect to the total weight of the composition, and water in a quantity needed to reach 100%.

Treatment foam: comprises a dispersion of a gas in a liquid medium; further the foam can exhibit characteristics of colloidal dispersions. The foam can be obtained by directly blowing a high-pressure gas into the liquid medium or by exploiting foaming agents.

In an embodiment, the treatment foam comprises the treatment liquid, as hereinbefore described and, optionally, one or more additives such as for example: foaming agents, wetting agents and viscosity modifying agents.

Suitable foaming agents are known to the person skilled in the art, and comprise, for example, surfactants, for example cationic, anionic, amphoteric, non-ionic surfactants; for example, alkyl betaines, particularly laurylamidopropylbetaine, can be used. Adapted wetting agents comprise, for example, silicone derivatives. Viscosity modifying agents comprise, for example, modified or substituted cellulose and poly(meth)acrylic acids and salts thereof, such as for example, ammonium salts, preferably: hydroxyethylcellulose, carboxymethylcellulose and cellulose dimethylpropane sulfonate.

The composition defining the treatment foam can, for example, comprise:

- a treatment liquid in a percentage comprised between 5% and 75%, preferably between 10% and 60% wt. with respect to the total weight of the composition,
- at least one foaming agent in a percentage comprised between 0.2% and 5%, preferably between 0.4% and 2% wt. with respect to the total weight of said composition, water in a quantity needed to reach 100%.

The wetting agent, if present in the composition of the treatment liquid used for producing the foam, has a percentage comprised between 0.001% and 5%, preferably from 0.01% to 1% wt. with respect to the total weight of said composition. The viscosity modifying agent, if present in the composition of the treatment liquid used for producing the foam, has a percentage comprised between 0.001 and 5%, preferably from 0.01% to 1% wt. with respect to the total weight of said composition. The medium which can be used for producing the foam of the invention is well known to the person skilled in the art, and many different mediums are commercially available. For example, in case a gas, for example air, is directly blown at high pressure into the liquid medium and/or in case foaming agents are used, a mechanical stirrer, a conventional mixer, or a foam generator can be used.

The density of the treatment foam is greater than 0.005 g/cm$^3$, preferably comprised between 0.01 g/cm$^3$ and 0.3 g/cm$^3$; the foam density was obtained by introducing a determined foam volume in a graduated laboratory cylinder of a known weight, by determining the weight of the foam and calculating the density from the known volume and weight. The expansion ratio of the treatment foam, defined as the ratio between the weight of the liquid and a weight of the same volume of foam prepared by this liquid, is comprised between 2:1 and 6:1, preferably between 3:1 and 5:1.

The average diameter of the cells of the foam, according to the invention, is greater than 0.05 mm, preferably comprised between 0.08 and 0.5 mm. The average diameter of the cells of the foam was measured by placing a foam sample on a microscope slide, by observing with a microscope having an enlargement of 32 times, and by counting the number of cells in an area of 6.77 mm$^2$. Particularly, the average diameter D of the cells, measured in mm, was determined by the equation:

$$D=2/\sqrt{\pi}*[(6.77)\ (\text{liquid density-foam density})/\text{cells number}]^{1/2}$$

Preferably, the treatment foam can comprise:

a treatment liquid in a percentage comprised between 5 and 75% wt. with respect to the total weight of the foam, such treatment liquid can comprise:

- at least one anti-migration agent, preferably selected among alginates, derivatives of the cellulose, such as carboximethylcellulose, hydroxyethylcellulose, acrylic (co)polymers, xanthan gum, Arabic gum, and guar gum, and/or
- at least one pH control agent, preferably selected among: sodium bicarbonate, sodium carbonate, ammonium sulfate, ammonium tartrate, and citric acid, and at least one hydrotropic agent, preferably selected between urea and thiourea,
- at least one foaming agent in a percentage comprised between 0.2% and 5%, preferably between 0.4 and 2% wt. with respect to the total weight of the foam, water in a quantity needed to reach 100%.

Plasma: comprises a partially ionized gas comprising a high concentration of ionic species and free radicals; the interaction of these species with a solid surface exposed to the plasma, causes chemical and physical modifications, at least on the surface of such material.

The plasma technology consists of exposing a gas to an electric field, generally at high frequency, the obtained plasma is a partially ionized gas comprising a high concentration of ionic species and free radicals; the interaction of these species with a solid surface exposed to the plasma, determines chemical and physical modifications on the surface of such material, but does not modify the deeper layers, leaving in this way unchanged the remaining characteristics of the starting material.

The gas, defined also as gas carrier, which can be used for generating the plasma, comprises at least one selected from the group of: air, nitrogen, nitrogen oxide (NO), ammonia, inert gases such as for example argon and helium, oxygen, hydrogen, carbon dioxide ($CO_2$), fluorinated gases such as for example $SF_6$ and $SOF_6$, hydrocarbon gases such as for example methane and ethane, fluorocarbon gases such as for example $CF_4$ and $C_2F_6$, alone or as a mixture. Using a system for vapourizing a liquid-phase compound enables to mix the above listed gas carriers with water vapour, ammonium hexamethyldisiloxane (HMDSO) vapours and vapours of other silanes, siloxanes, hydrocarbons and perfluorinated compounds. It is possible to fall in all the ranges of concentrations of gases, or mixtures of gases, and vapour in order to reach the saturation concentration (in other words the concentration wherein a liquid is in equilibrium condition with the vapour thereof at a given value of temperature and pressure) of said liquid at the used temperature and pressure conditions. It is also possible to use systems generating colloidal (aerosol) dispersions, adapted to mix liquid compounds with the above described gases or solid compounds, including micro- and nano-particles.

The plasma is formed by supplying energy to the gas in order to reorganize the electronic structure thereof and generate excited species and ions; for the sake of the present discussion, it is supplied the energy produced by the electric current and particularly plasmas generated in direct current.

In an advantageous but non limiting way, the plasma is generated by a system known as barrier electric discharge (DBD); such system comprises at least two flat and parallel metal electrodes, placed at a predetermined distance from each other. The gas by which the plasma is generated is caused to flow between the two electrodes; the discharge is generated by a sinusoidal or pulsed current which leads to the generation of micro-arches which develop due to the electrons building up on the dielectric layer by which, one of the electrodes is covered. Due to the presence of this layer, the micro-arches are randomly generated both in terms of space and time, and this fact ensures a suitable treatment homogeneity.

Particularly, for the sake of the present discussion, it will be made reference, in a non limiting way, to a plasma generated by an electric field at an atmospheric pressure: the electric field transmits energy to the gas electrons, and by collision, this is then transmitted to the neutral species.

Particularly, the electrode pair of the DBD (dielectric barrier discharge), dielectric barrier discharge, is separated by one or two dielectric barriers formed by insulating plates placed on one or both the electrodes.

The electrode pair is supplied by high tension (kV) and at high frequency (kHz) which are defined in the following. When the voltage is greater than the break-down voltage $V_B$ of the negative electrode, a plasma filament extends towards the positive electrode and starts the conduction process. The electrons in the plasma are thrusted towards the dielectric above the positive electrode. Suitable potentials are required for ionizing the gas. The ionizing potential actually depends on the distance between the electrodes and on the pressure according to the Paschen law.

$$V_b = \frac{B \cdot (p \cdot d)}{\ln[A \cdot (p \cdot d)] - \ln\left[\ln\left(1 + \frac{1}{\gamma_{se}}\right)\right]}$$

where d is the distance between the electrodes, p is the pressure, A and B are experimental constants and y is the emission coefficient of the secondary electrons of the cathode. Specifically, the potential difference between two or more electrodes can be defined in a range comprised between 1 kV and 50 kV, preferably comprised between 5 and 25 kV.

The intensity of the applied current is generally comprised between 100 and 200 A, preferably is 180 A. The supply frequency of the electrodes is greater than 1 kHz, particularly is comprised between 1 and 20 kHz. The discharge can occur substantially at the atmospheric pressure, preferably is comprised between 500 and 1500 mbar, still more preferably between 800 and 1200 mbar. The distance between the electrodes instead is comprised between 1 and 20 mm, particularly between 1 and 12 mm.

Moreover, it is possible to define a power per surface unit transmitted by the discharge of the processed material expressed in terms of "dose", measured in W*min/m$^2$. Such power parameter is defined as:

Dose=Power/(electrode width*sliding speed of the sheet fibrous material)

Wherein the power is understood as the ratio between the potential difference (V) defined between the electrodes, and the intensity of the current (I) flowing in the same. The term electrode width means the active surface facing the sheet fibrous material and adapted to transmit the electric discharges. The sliding speed is understood as the speed of the sheet fibrous material passing through the electrodes. The value of a dose (D) is less than 3,000 W*min/m$^2$, preferably is comprised between 30 and 1,000 W*min/m$^2$, still more preferably between 190 and 800 W*min/m$^2$. The power per surface unit transferred by the discharge of the processed material expressed in Wt/cm$^3$ is comprised between 0.003 and 3 Wt/cm$^3$.

It is possible to implement different treatments on the sheet fibrous material by means of the plasma and particularly it is possible to obtain a change, particularly an increase, at least superficial, of the hydrophobicity of said sheet material which enables, for example, to increase the yield of the printing, particularly of the digital printing, and the dyeing capability.

Hydrophobicity: the term water-repellency or hydrophobicity means the physical properties of chemical species (for example molecules) of being repelled by water. Moreover, this term is used with a more general meaning for denoting the property of materials of not absorbing and not retaining water inside them or on their surface.

The variation of hydrophobicity of the fibrous material before and after the plasma-treatment is measured by the contact angle, in other words the magnitude of the angle, measured in Angstrom degrees, present between the surface of the fibrous material and the tangent to the liquid-vapour interface of a water drop.

The hydrophobicity variation of the fibrous material before and after the plasma treatment according to the invention, can be measured when the surface of a sample of the fibrous material contacts a distilled water drop 1 cm high for 60 seconds, by measuring the quantity in grams of distilled water absorbed by the material, and weighing the sample of the material before and after the test. The results are expressed in grams/m$^2$ of absorbed water.

Standard atmosphere: an atmosphere at a temperature of 288.15 K (15° C.), at a pressure of 101.325 kPa (1 tm) and at a humidity of 0.00.

DETAILED DESCRIPTION

Printing Plant generally indicates a plant for printing, particularly for digitally printing, a sheet fibrous material T. The plant 1, object of the invention, is useable for ink-printing at least one side of said sheet fibrous material T which, for example, can be formed by or can comprise a fabric and/or non-woven fabric. Generally, but in a non limiting way, the plant 1 can be applied in the textile or knitted fabric or non-woven fabric industry for printing by ink.

As it is visible in the attached figures, the plant 1 comprises at least one conveyor belt 2 movable along a closed path, particularly between at least one first and one second end idler members, along a predetermined movement direction. The conveyor belt 2 exhibits a structure having two dimensions: length and width (the width is identified by the letter L as illustrated in FIG. 12), substantially prevalent with respect to a third dimension, such as the thickness; the length is defined along the predetermined movement direction of the belt, while the width L is defined normal to said direction. The conveyor belt 2 is defined by a continuous layer having a substantially constant width along all the development of the conveyor 2 itself. The conveyor belt 2 exhibits two main surfaces or sides: an exposed surface and an inner surface. The inner surface is configured for directly contacting the idler members adapted to guide the belt 2 along the predetermined movement direction while the exposed surface is configured for receiving the sheet fibrous material T; particularly, the exposed surface is configured for facing and receiving a first side T1 of the sheet fibrous material T. In a preferred, but non limiting configuration of the invention, the conveyor belt 2—at least at a continuous longitudional band of the exposed surface destined to receive the sheet fibrous material T—is devoid of through openings crossing the thickness of the belt 2 itself; particularly, at least the exposed surface destined to receive the sheet fibrous material T is completely smooth, devoid of holes (through openings, for example) and advantageously devoid of valleys and projections. Advantageously, but in a non-limiting way, the conveyor belt 2 comprises at least one continuous layer of water-proof material defining the exposed surface and capable of providing the surface itself, according to a view normal to a movement direction of the belt, with a continuous and preferably rectilinear outline. For example, the conveyor belt 2 can be made at least partially of at least one material selected in the group of the following: elastomeric materials, silicon, silicon rubber or more.

As it is visible in the attached figures, at least part of the closed path of the conveyor belt 2 defines an operative tract 3 conveying the sheet fibrous material T; the operative tract is defined by the belt 2 portion moving the sheet fibrous material T, in other words by the belt 2 portion directly supporting the fibrous material T. The operative tract 3 can be defined by a path portion between the first and second idler members or, as for example illustrated in FIGS. from 1 to 3, by the overall portion of the belt 2 comprised between said idler members: in this latter described configuration, the operative tract 3 substantially extends from the first idler member to the second idler member. However, it is not excluded the possibility that the operative tract 3 could be defined by just one portion of the belt 2 extending between said idler members (this condition is not illustrated in the attached figures).

In a preferred, but non limiting configuration of the invention, the conveyor belt 2 comprises only the first and second idler members and therefore exhibits a closed substantially rectangular path, radiused at said members; under such condition, the operative tract 3 is defined by at least one rectilinear portion of the rectangular path: therefore the sheet material T would be conveyed by the belt along a rectilinear length, particularly a flat one. De facto, the conveyor belt 2 is configured for temporarily receiving and supporting the sheet fibrous material T; during the movement of the conveyor belt 2, this latter is configured for movably guiding the sheet fibrous material T along an advancement direction A (see FIGS. from 4 to 9, for example). The conveyor belt 2—and consequently the sheet fibrous material T—is moved by at least one motor active on one or both the idler members of the conveyor belt 2. In an embodiment of the invention, at least part of the exposed surface of the conveyor belt 2 is adhesive: the conveyor belt 2 is configured for temporarily constraining the sheet fibrous material T in correspondence of the operative tract 3.

From the dimensional point of view, the conveyor belt 2 is configured for having a width L equal to or greater than a maximum width of the sheet fibrous material T (see FIG. 12, for example); such widths are measured normal to the advancement direction A of the fibrous material T. Moreover, as hereinbefore described, the conveyor belt 2 defines an operative tract 3 substantially defined by the section of the belt 2 adapted to contact and support the sheet fibrous material T. In a preferred, but non limiting configuration of the invention, the operative tract 3 extends along a rectilinear prevalent development direction: under an operative condition of the plant 1, such prevalent development direction of the operative tract 3 is substantially horizontal. The longitudinal extension or length of the operative tract 3 is comprised between 0.5 and 10 m, particularly between 0.5 and 6 m; the length of the operative tract 3 of the conveyor belt 2 is measured along the movement direction of the conveyor belt 2 itself, particularly along the advancement direction A of the sheet fibrous material T. The conveyor belt 2—during a predetermined operative condition—is configured for moving continuously the sheet fibrous material T at a speed constantly greater than 0 along the advancement direction A: during the operative condition of the conveyor belt 2, the same is always constantly moving. Again, in other words, during the operative condition of the conveyor belt 2 the same does not provide a movement at alternated steps, and therefore does not provide stops of the belt, along the movement direction.

Figure 3:
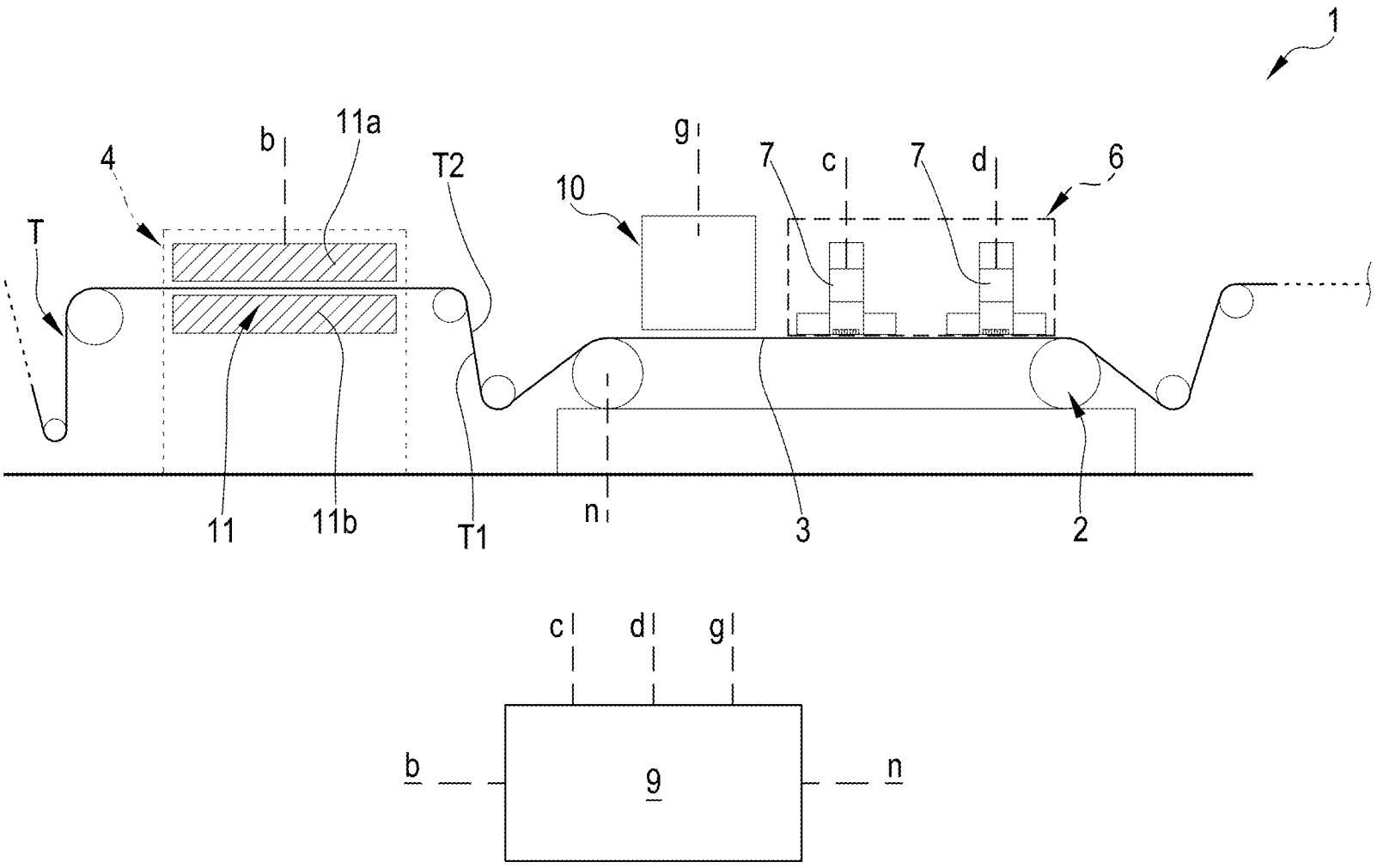

In a preferred but non limiting configuration of the invention, the plant 1 comprises at least one control unit 9 active on the conveyor belt 2—particularly on the motor—which is configured for commanding the movement of the conveyor belt 2 (see FIG. 3 for example, wherein the control unit 9 is connected to the conveyor belt 2 by a connecting line "n"). Particularly, the control unit 9 is configured for defining the operative condition wherein the conveyor belt 2 is configured for continuously moving, along the advancement direction A, the sheet fibrous material T at a speed constantly comprised between 20 and 100 m/min, particularly comprised between 30 and 70 m/min. In a configuration of the plant 1, this latter comprises at least one sensor engaged with the conveyor belt 2, and capable of emitting a signal related to the motion of the conveyor belt 2. The control unit 9 is connected to said sensor and is configured for:

- receiving from the sensor, a signal related to the movement of the conveyor belt 2,
- managing, as a function of said signal, a movement speed of the conveyor belt 2 and therefore a movement speed of the sheet fibrous material T along the advancement direction A.

As it is visible in the attached figures, the plant 1 further comprises a printing station 6 configured for ink-printing, particularly for digitally printing, at least part of a second side T2 of the sheet fibrous material T opposite to the first side T1. The printing station 6 operates at the conveyor belt 2 and is configured for printing the sheet fibrous material T (particularly the second side T2) placed on the operative tract 3 of the conveyor belt 2.

The printing station 6 comprises at least one printing module 7 extending transversally, particularly normal, with respect to the movement direction of the conveyor belt 2. In a preferred, but non limiting configuration of the invention, each printing module 7 exhibits a width, measured normal to the movement direction of the belt 2, slightly less (5%-10% for example), equal to or greater than the width of the conveyor belt 2. De facto, each printing module 7 is configured for defining a width equal to or greater than the width of the sheet fibrous material T which, during the use, adheres to the conveyor belt; such width being measured normal to the advancement direction A of the sheet fibrous material T.

Each printing module 7, during the predetermined operative condition of the conveyor belt 2 (a continuous movement of the conveyor belt and therefore a continuous movement constantly at a speed greater than 0 of the sheet fibrous material T), is configured for:

defining a printing on the whole width of the sheet fibrous material T, remaining in a stationary position and printing the second side T2 of the sheet fibrous material T sliding on the operative tract 3.

After all, providing a printing module 7 extending along all the width of the fibrous material T, enables the same module to remain stationary—particularly enables to not perform any type of displacement along a longitudional direction and/or transversal to the movement direction of the conveyor belt 2—during the operative condition of the conveyor belt (a continuous movement of the belt 2) and to perform a continuous printing on the sheet fibrous material T by just the movement imparted to the fibrous material T.

More particularly, each printing module 7 comprises a plurality of heads 8 (FIGS. 12-14) configured for covering with the respective nozzles, the overall width of the conveyor belt, particularly of the sheet fibrous material T. FIGS. 12 and 13 illustrate a configuration of the printing module 7 exhibiting at least one first and one second series of heads 8; each series comprises heads aligned along the prevalent development direction normal to the movement direction of the conveyor belt 2, the first and second series of heads are adjacent and immediately consecutive to each other along the movement direction of the conveyor belt 2. As it is visible in the detailed schematic view in FIG. 13, a head 8 of the first row exhibits, with respect to the movement direction of the conveyor belt 2, an overlapping portion with at least two adjacent heads 8 and immediately consecutive to the second row (FIG. 13). As it is visible, the nozzles present on the heads ensure therefore to completely cover the printing width.

In a further embodiment illustrated in FIG. 14, each printing module 7 exhibits a plurality of heads 8 aligned along a prevalent development direction, normal to the movement direction of the conveyor belt 2, for defining an aligned series of heads 8; a first head 8 of said aligned series exhibits an end portion overlapping, with respect to the movement direction, the conveyor belt 2 with an end portion of a second head 8; the first and second heads of said series are adjacent and immediately consecutive to each other along the prevalent development direction of the plurality of heads (see FIG. 14). Also in this case, the nozzles present on the heads ensure to completely cover the printing width.

As hereinbefore described, in a preferred but non limiting embodiment of the invention of the plant 1, this latter comprises a control unit 9 active on the conveyor belt 2 and connected to a sensor engaged with said belt 2; further the control unit 9 is connected to the printing station 6 (see the connecting lines c-d-f in FIG. 1, for example), and configured for:

receiving from the sensor engaged with the belt 2, a signal related to the movement of the conveyor belt 2, managing, as a function of said signal, a movement speed of the conveyor belt 2 and therefore a movement speed of the sheet fibrous material T along the advancement direction A, commanding, based on the movement speed of the conveyor belt, the printing station 6 for managing a predetermined quantity of ink to be supplied on the sheet fibrous material T.

Particularly, the control unit 9 is configured for managing the continuous movement of the conveyor belt 2 and simultaneously managing the printing station 6 as a function of the movement speed of the sheet fibrous material T along the advancement direction A.

In an embodiment of the invention, the plant 1 comprises at least one station 4 for preparing the sheet fibrous material T configured for at least partially treating the second side T2 of the sheet fibrous material T. The preparing station 4 is placed upstream the printing station 6 with respect to the advancement direction A of the sheet fibrous material T.

Figure 1:
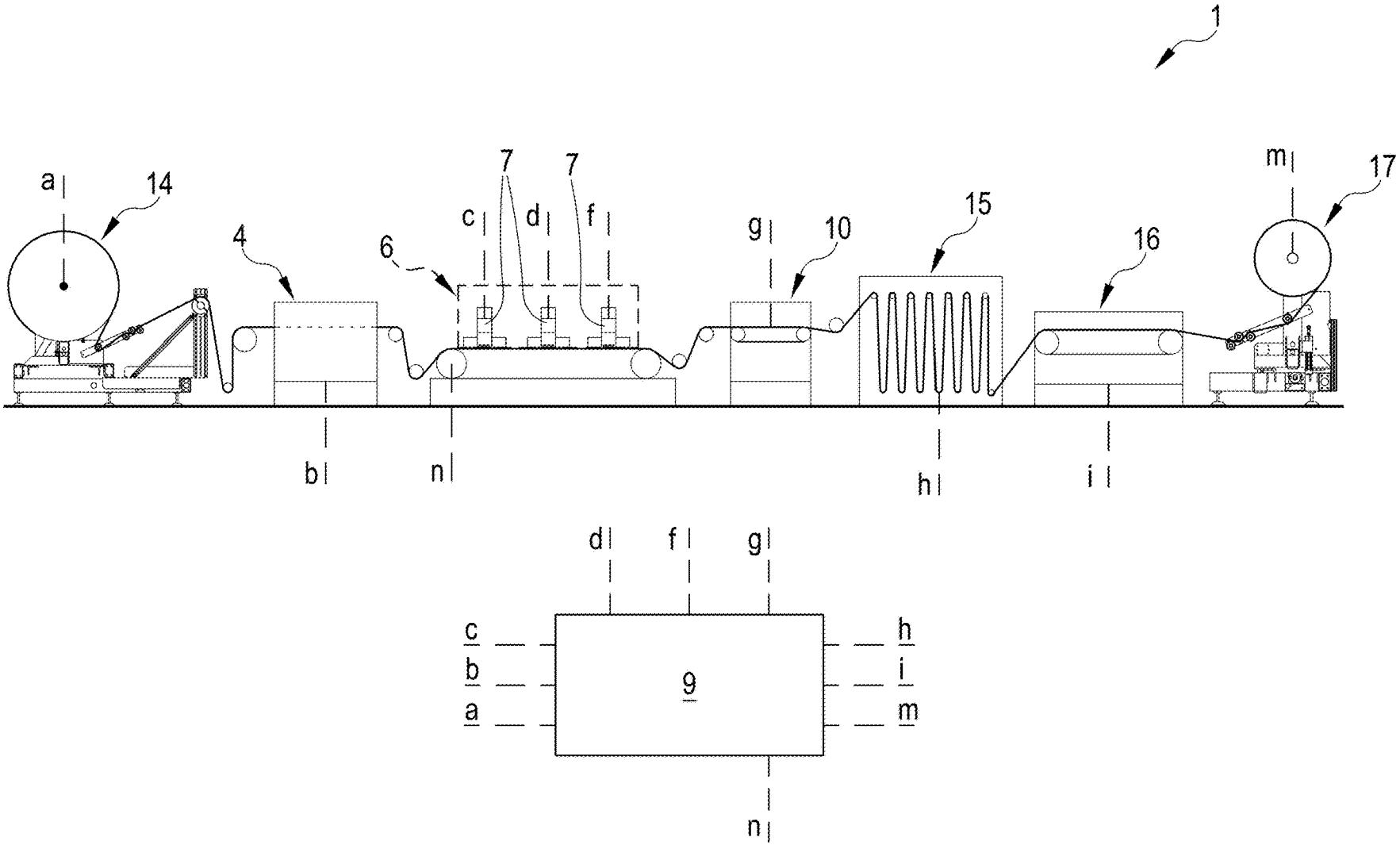
Figure 4:
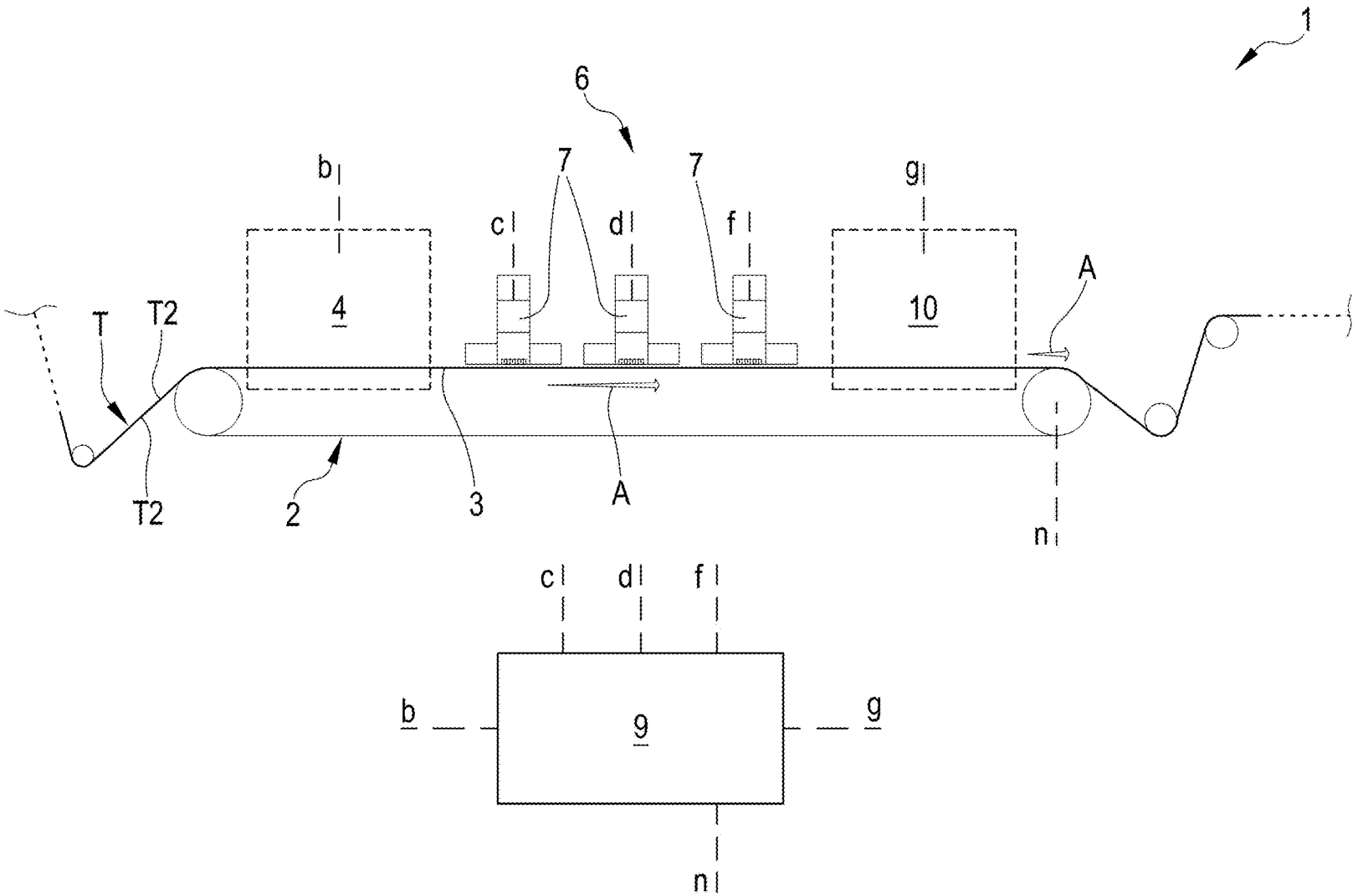

In a first embodiment, the preparing station 4 is configured for placing on the sheet fibrous material T a predetermined quantity of the treatment composition M comprising at least one of: a treatment liquid and treatment foam. As illustrated in FIG. 1, the preparing station 4 can be placed upstream the conveyor belt 2 so that the sheet fibrous material T is treated—by the treatment composition M—before the sheet fibrous material T itself comes in contact with the conveyor belt 2 (before the operative tract 3). FIG. 4 illustrates a further variant of the preparing station 4 wherein the same is placed at the conveyor belt 2: in this latter configuration, the preparing station 4 is configured for placing on the sheet fibrous material T, placed on the operative tract 3, the treatment composition M.

As hereinbefore described, in an embodiment of the invention, the conveyor belt 2 defines an operative condition wherein the same continuously moves the sheet fibrous material T constantly at a speed greater than 0; in the first embodiment, the preparing station 4 is configured for placing, during the predetermined operative condition, on the sheet fibrous material T, the treatment composition M. More particularly, the preparing station 4 and printing station 6 are placed immediately consecutive to each other along the advancement direction A of the sheet fibrous material T; the conveyor belt 2, during the operative condition, is configured for continuously moving the sheet fibrous material T through the preparing station 4 and printing station 6. Particularly, a station for drying the sheet fibrous material T is not provided between the preparing station 4 and printing station 6: the material printed in the preparing station 4 is not dried before entering the printing station 6.

In the first embodiment of the preparing station, the treatment composition M supplied either as a treatment liquid or treatment foam can for example comprise at least one of the following agent: an anti-migration agent, a pH control agent, a hydrotropic agent.

In the first embodiment of the preparing station 4, this latter is configured for placing, on the sheet fibrous material T sliding on the operative tract 3 of the conveyor belt 2, a predetermined quantity of the treatment composition; said treatment composition M quantity is selected so that the sheet fibrous material T itself exhibits a weight percentage per square meter variation between a section immediately upstream and one immediately downstream the preparing station 4, less than 70%, particularly comprised between 10% and 50%, still more particularly comprised between 10% and 30%. Moreover, still referring to the first embodiment of the preparing station 4, this latter is configured for placing on the sheet fibrous material T sliding on the operative tract 3 of the conveyor belt 2, a predetermined quantity of the treatment composition M; said quantity of the treatment composition is selected so that the sheet fibrous material T itself exhibits a weight percentage per square meter variation, between a section immediately upstream the preparing station 4 and one immediately upstream the printing station 6, less than 70%, particularly comprised between 10 and 50%, still more particularly between 10 and 50%. In other words, the preparing station 4 is configured for placing, on the sheet fibrous material T sliding on the operative tract 3 of the conveyor belt 2, a predetermined quantity of the treatment composition M; said quantity of the treatment composition is selected so that the sheet fibrous material T itself exhibits a weight percentage per square meter variation, between a section immediately downstream the preparing station 4 and one immediately upstream the printing station 6, comprised between 0% and 10%.

As hereinbefore described with reference to a preferred but non limiting configuration of the invention, the plant 1 comprises the control unit 9. In such configuration, the control unit 9 can be connected also to the preparing station 4 and is configured for:

commanding the movement of the conveyor belt 2, commanding the preparing station 4 to manage the application of the predetermined quantity of the treatment composition M on the sheet fibrous material T.

Particularly, the control unit 9 is configured for:

receiving, for example from the sensor engaged with the conveyor belt 2, a signal related to the movement of the conveyor belt 2, calculating, as a function of said signal, the movement speed of the sheet fibrous material T along the advancement direction A, as a function of the movement speed of the fibrous material T, commanding to dispense a predetermined quantity of the treatment composition M.

The predetermined quantity of the treatment composition M, managed by the control unit 9, is selected so that the sheet fibrous material T itself exhibits a weight percentage per square meter variation, between a section immediately upstream and one immediately downstream the preparing station 4, less than 70%, particularly comprised between 10% and 50%, still more particularly between 10% and 30%. Optionally, said quantity of the treatment composition M, managed by the control unit 9, is selected so that the sheet fibrous material T exhibits a weight percentage per square meter variation, between a section immediately downstream the preparing station 4 and one immediately upstream the printing station 6, comprised between 0% and 10%.

Further, the control unit 9 can be configured for managing the movement speed of the conveyor belt 2 so that, during the operative condition of the same, the travelling time of a point of the sheet fibrous material T, from an outlet of the preparing station 4 to an inlet of the printing station 6, is less than 60 sec, particularly less than 30 sec, still more particularly in a time comprised between 0.5 and 20 sec.

In the first embodiment of the preparing station 4, this latter comprises an applicator 5 configured for disposing on the second side T2 of the sheet fibrous material T placed on the operative tract 3, the treatment composition M. In case of a plant 1 comprising the control unit 9, this latter is active on the applicator 5 and is configured for commanding to dispense the treatment composition M.

Figure 6:
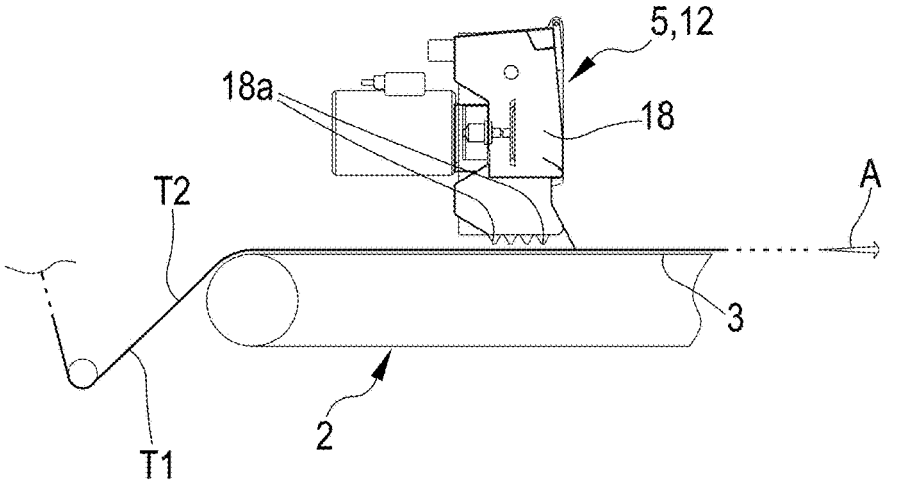

In a first example, the applicator 5 of the preparing station 4 comprises at least one spray dispenser 18 (FIG. 6) spaced above the operative tract 3. In such configuration, the treatment composition M comprises, in a non limiting way, a treatment liquid. The applicator 5 can comprise just one spray dispenser 18 extending all long the width of the conveyor belt 2 and exhibiting a plurality of nozzles 18*a* enabling the dispenser 18 to apply the treatment liquid on the whole width of the sheet fibrous material T. In an embodiment variant of the first example, the applicator 5 can comprise a plurality of spray dispensers 18, each of them exhibits one or more dispensing nozzles 18*a*, configured for enabling to apply the treatment composition M on the whole width of the sheet fibrous material T.

Figure 7:
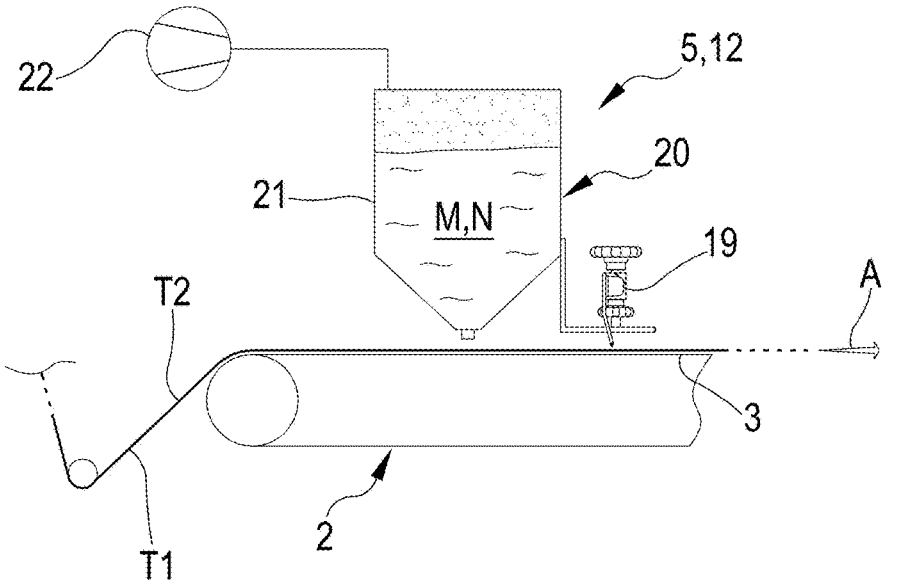

In a second example, the applicator 5 of the preparing station 4 comprises a spreading doctor blade 19 (FIG. 7) placed transversally to the motion of the conveyor belt 2 and spaced above the operative tract 3. The spreading doctor blade 19 can be associated to a distributor 20 of the treatment composition M configured for placing on the second side T2 of the sheet fibrous material T a predetermined quantity of the treatment composition M. The doctor blade 19 is placed immediately downstream the distributor 20 according to the advancement direction A of the sheet fibrous material T and configured for coating on the second side T2 of the sheet fibrous material T, the treatment composition M dispensed by the distributor 20. Employing a spreading doctor blade is, in a non-limiting way, advantageously useful for coating a material M comprising a treatment foam. FIG. 7 illustrates a preferred but non limiting embodiment of the distributor 20 comprising a pressurized reservoir 21 inside which the treatment composition M is present; the pressurized reservoir 21 fluidically communicates with a compressor 22 configured for introducing pressurized air in the reservoir 21 for enabling to dispense the treatment composition M. In a preferred configuration of the invention, the control unit 9 is active on the compressor 22 and is configured for:

receiving from a sensor, a signal related to an operative parameter representative of at least one of: a pressure inside the reservoir 21, a level of the treatment composition M inside the reservoir 21, determining, as a function of said signal, the composition quantity which is dispensed from the reservoir 21, comparing the value related to the quantity of the dispensed treatment composition with an optimal value, as a function of the comparison, commanding the compressor in order to control the quantity of the dispensed composition of the reservoir 21.

In a third example, the applicator 5 of the preparing station 4 comprises a drum 23 placed with the rotation axis transversal to the motion of the conveyor belt 2 and with the lateral surface spaced above the operative tract 3 of the conveyor belt 2. The drum 23 exhibits a hollow interior destined to receive a predetermined quantity of the treatment composition M and being provided with a predetermined number of nozzles or slits for dispensing the same. The drum is useable, in a non limiting way, for applying a composition M comprising a treatment foam: in such configuration, the drum 23 can be supplied by a foam generator 13 configured for generating a predetermined quantity of foam which is then supplied inside the drum 23 which will provide to dispense and coat the foam on the sheet fibrous material T. In a preferred configuration of the invention, the control unit 9 is active on the foam generator 13 and on the drum 23 and is configured for:

receiving, from the sensor engaged with the belt 2, a signal related to the movement of the conveyor belt 2, managing, as a function of said signal, a movement speed of conveyor belt 2 and therefore a movement speed of the sheet fibrous material T along the advancement direction A, as a function of the movement speed of the conveyor belt 2, commanding the foam generator 13 to dispense a predetermined quantity of foam to the drum 23, as a function of the movement speed of the conveyor belt 2, managing the rotation speed of the drum 23 so that the same can suitably coat the foam on the sheet fibrous material T.

In a fourth example, the applicator 5 of the preparing station 4 comprises an applicator roll (this condition is not illustrated in the attached figures) with an associated respective doctor blade for adjusting a thickness of the treatment composition M deposited on a lateral surface of the applicator roll. The applicator roll and doctor blade extend transversally with respect to the conveyor belt 2 and substantially extend along the whole width of said belt. The applicator roll is placed with a rotation axis transversal to the motion of the conveyor belt 2 and with the lateral surface spaced above the operative tract 3 of the conveyor belt 2.

Figure 9:
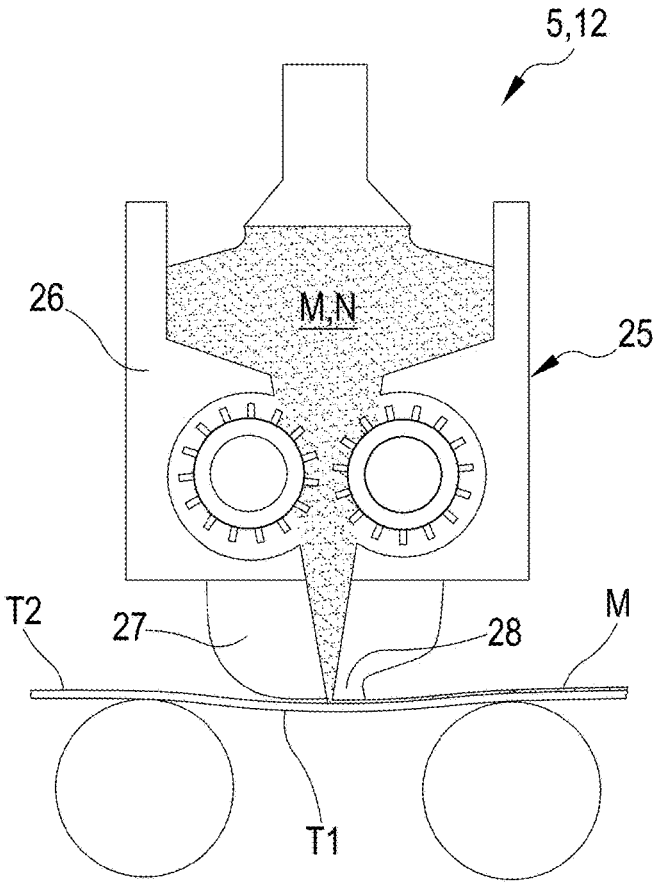

In a fifth example, the applicator 5 of the preparing station 4 comprises a distributor 25 comprising a reservoir 26 configured for receiving the treatment composition M. The reservoir 26 exhibits at least one dispensing nozzle 27 placed on and in contact with the sheet fibrous material T: the nozzle 27 extends transversally to the conveyor belt 2 along the whole width of this latter. The interior of the reservoir 26 receives at least one pusher, for example defined by a toothed wheel, configured for dispensing the treatment composition M—a liquid or a treatment foam for example—from the nozzle 27. As it is visible from FIG. 9, the nozzle 27 is advantageously provided with a regulator 28 placed immediately downstream the outlet of the treatment composition M, with respect to the advancement direction A of the sheet fibrous material T; the regulator 28 is substantially configured for uniformly coating the composition exiting the nozzle 27 on the sheet fibrous material T. The distributor 25 illustrated in FIG. 9 is represented outside the conveyor belt 2; however, the distributor 25 can operate as hereinbefore described with reference to the preparing station 4, at the conveyor belt 2 and particularly can treat the fibrous material sliding on the operative tract of the conveyor belt 2.

Advantageously, as hereinbefore described, the plant 1 can comprise a control unit 9; in such configuration, the unit 9 can be active on the pusher for managing the quantity of the treatment composition M to be dispensed on the conveyor belt 2. More particularly, the control unit 9 is connected to the pusher and is configured for:

receiving, from the sensor engaged with the belt 2, a signal related to the movement of the conveyor belt 2, managing, as a function of said signal, a movement speed of the conveyor belt 2 and therefore a movement speed of the sheet fibrous material along the advancement direction A, as a function of the movement speed of the conveyor belt 2, managing the pusher (when a toothed wheel manages the rotation speed of the wheel, for example) for dispensing a predetermined quantity of the treatment composition M on the sheet fibrous material T.

The attached figures illustrate, in a non limiting way, an embodiment of the plant 1 wherein the preparing station 4 is placed at the operative tract 3; the preparing station 4, as hereinbefore described, is configured for treating at least part of the second side T2 of the sheet fibrous material T by placing the treatment composition M (treatment liquid or foam) on the second side T2 placed on the operative tract 3 of the belt 2: the predetermined quantity of the treatment composition M is directly placed on the second side T2.

In an embodiment variant not illustrated in the attached figures, the treatment composition 4 is placed upstream the operative tract 3 of the belt 2 and is configured for treating the fibrous material by a deposition of the treatment composition M on the first side T1 and by a migration of the composition M through the fibrous material: in this way, the migration of the composition from the first to the second side T2 causes an undirect deposition of the predetermined quantity of the treatment composition on the second side T2.

The treatment composition M, as hereinbefore described, can comprise a treatment liquid and/or foam. The treating station 4 is configured for enabling to directly apply the treatment composition M on the first side T1 of the fibrous material T opposite to the side T2 destined to be printed; such direct application can occur by at least one of:

a direct deposition of the composition on the first side T1 of the fibrous material T; or a direct deposition on the exposed surface S of a deposition length of the conveyor belt 2 placed upstream the operative tract 3.

As hereinbefore specified, the operative tract 3 represents the portion of the belt 2 in contact with the material T. When the treatment composition is applied on the first side T1 or on the exposed surface S of the belt 2, such composition is configured for initially directly contacting only the first side T1 of the fibrous material; after placing the fibrous material on the conveyor belt 2 for defining said operative tract 3, the treatment composition is thrusted through the sheet fibrous material from the first side T1 for enabling to treat the fibrous material and particularly to indirectly treat the second side T2.

In a preferred but non limiting embodiment of the just described embodiment variant, the treatment composition is directly applied on the exposed surface S of the conveyor belt 2; then the composition is guided by the belt 2 to an initial contacting area of the fibrous material T on the belt 2. At the initial contacting area, there are means for bonding the fibrous material T to the belt. For example, said bonding means can comprise at least one of: one or more pressure rolls, a doctor blade. Such bonding means are configured for pressing the sheet fibrous material T on the belt 2 and therefore for enabling to indirectly treat the second side T2 by the migration of the treatment composition through the fibrous material from the first side T1 to the second side T2.

In the just described embodiment variant, the preparing station 4 can comprise an applicator—of the type as hereinbefore described—operating upstream the initial contacting area between the material T and belt 2, particularly below the material T, and above the deposition length of the conveyor belt.

In a second embodiment of the preparing station 4, this latter is configured for modifying the hydrophobicity—at least the surface hydrophobicity—of at least part of the sheet fibrous material T. More particularly, the preparing station 4 is configured for increasing the surface hydrophobicity of at least part of the sheet fibrous material T passing through said preparing station 4. Specifically, the preparing station 4 is configured for increasing the surface hydrophobicity of the whole second side T2 of the sheet fibrous material T passing through said preparing station 4. Quantitatively, the ratio between the hydrophobicity of a section of the second side T2 of the fibrous material T immediately downstream the preparing station 4 (second embodiment) and the hydrophobicity of a section of a second side T2 of the fibrous material immediately upstream the preparing station 4, is greater than 1.1, particularly greater than 1.5, still more particularly comprised between 1.5 and 5.

Figure 5:
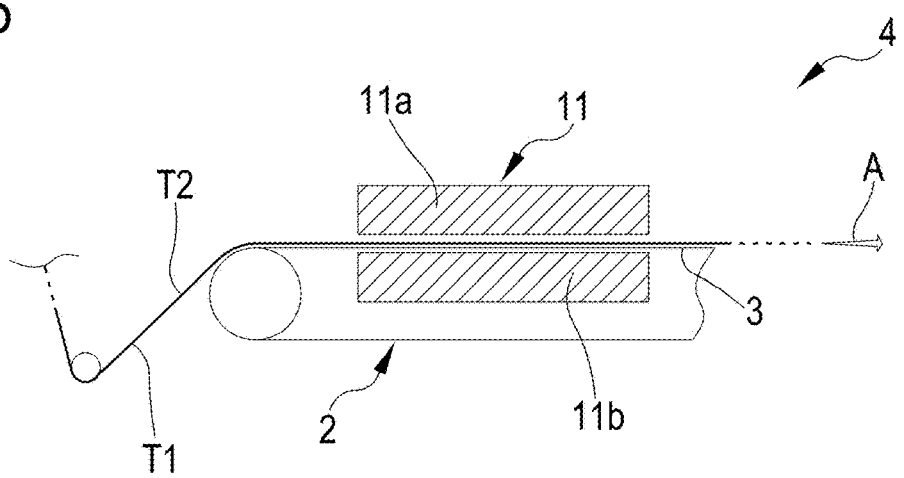

As illustrated in FIG. 1, the preparing station 4 can be placed upstream the conveyor belt 2 (see FIGS. 2 and 3, for example) so that the sheet fibrous material T is treated—by increasing the hydrophobicity—before the same sheet fibrous material T comes in contact with the conveyor belt 2 (before the operative tract 3). FIG. 5 illustrates a further variant of the preparing station 4 wherein the same is placed at the conveyor belt 2: in this latter configuration, the preparing station 4 is configured for defining the increase of the hydrophobicity of the sheet fibrous material T placed on the operative tract 3.

As hereinbefore described, in an embodiment of the invention, the conveyor belt 2 defines an operative condition wherein the same continuously moves the sheet fibrous material T constantly at a speed greater than 0; the preparing station 4 (in the second embodiment thereof) is configured for modifying the hydrophobicity of the fibrous material T, during the predetermined operative condition. More particularly, the preparing station 4 and printing station 6 are placed immediately consecutive to each other along the advancement direction A of the sheet fibrous material T; the conveyor belt 2, during the operative condition, is configured for continuously moving the sheet fibrous material T through the preparing station 4 and printing station 6. Particularly, between the preparing station 4 and printing station 6, it is not present a drying station.

The preparing station 4 (according to the described embodiment) comprises at least one plasma-treating device 11 configured for defining a treating environment wherein at least one portion of the fibrous material is received and wherein an ionized gas is present. Particularly, the plasma-treating device 11 is configured for generating plasma in the treating environment by using one or more of the following gases: air, nitrogen, nitrogen oxide (NO), ammonia, inert gases such as for example argon and helium, oxygen, hydrogen, carbon dioxide ($CO_2$), fluorinated gases such as for example $SF_6$ and $SOF_6$, hydrocarbon gases such as for example methane and ethane, fluorocarbon gases such as for example $CF_4$ and $C_2F_6$, alone or in a mixture, preferably nitrogen, still more preferably 2 $l_n$/min nitrogen ($l_n$/min means liters per minute under standard conditions wherein the standard conditions are defined at a temperature of 0° C. and at a pressure of 1.013 bar). Optionally, the plasma device 11 is configured for generating plasma at a treating environment by using one or more of said gases mixed with one or more of: water vapour, ammonium hexamethyldisiloxane (HMDSO) vapours, and vapours of other silanes, siloxanes, hydrocarbons and perfluorinated compounds.

Figure 2:
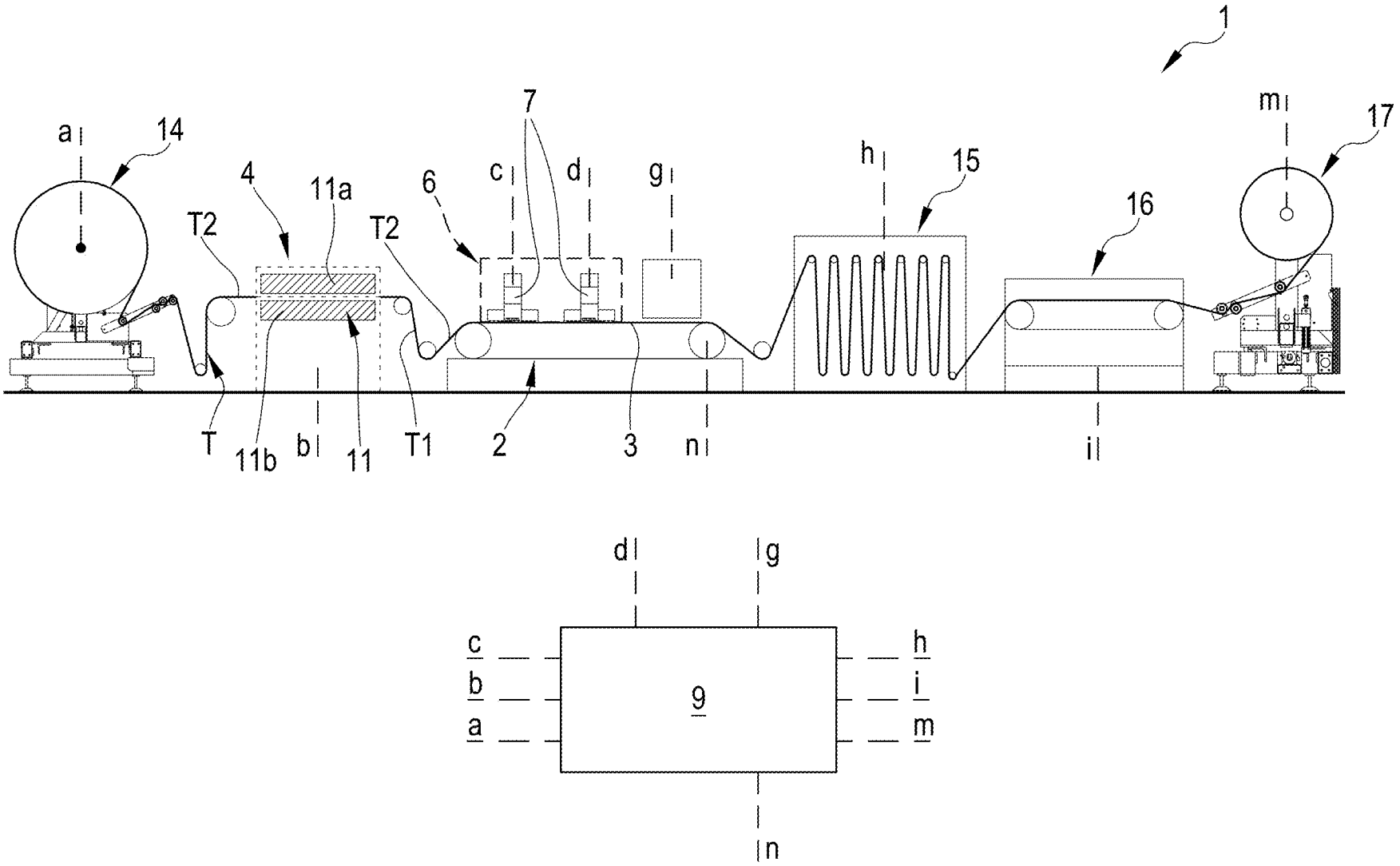

The plasma-treating device 11 comprises at least one first and one second electrodes 11*a*, 11*b* placed at a predetermined distance from each other, particularly comprised between 1 and 12 mm, the sheet fibrous material T passing in between. Such electrodes system is also defined as a barrier electric discharge system (DBD). FIGS. 2, 3 and 5 illustrate a non limiting embodiment of the invention wherein the plasma-treating device 11 comprises two electrodes (one first and one second electrodes identified by references 11*a* and 11*b*); however, the device can comprise a number of electrodes for example comprised between 2 and 64.

The device 11 comprises an electric circuit on which the electrodes are operatively active and a generator (non illustrated in the attached figures), particularly an electric field generator, which is configured for defining a potential difference between the electrodes comprised between 1 and 50 kV, particularly between 5 and 25 kV. The generator is configured for defining a current intensity in the circuit comprised between 100 and 200 A, preferably of 180 A. The supplying frequency of the electrodes is greater than 1 kHz, particularly comprised between 1 and 20 kHz. The device 11 is adapted to operate substantially at the atmospheric pressure; de facto, the device 11 is substantially open to the environment so that the sheet fibrous material can continuously slide between the electrodes (by continuously sliding through the preparing station 4). More particularly, the current discharge between the electrodes develops at a pressure comprised between 500 and 1500 mbar, still more preferably between 800 and 1200 mbar.

Moreover, the plasma device 11 is configured for transmitting the power of the electric discharge between the electrodes per surface unit of the processed sheet fibrous material T; such parameter was defined as a dose and is measured in W*min/$m^2$. Specifically, such power parameter is defined as:

Dose=Power/(electrode width*speed of the fibrous material)

wherein the power is understood as the ratio between the potential difference (V) between the electrodes and the current intensity (I) measured inside the circuit. The term "electrode width" means the active surface facing the sheet fibrous material T and is adapted to transmit the electric discharge. The term "sliding speed" means the speed of the sheet fibrous material passing between the electrodes.

The value of a dose is less than 300 W*min/$m^2$, preferably is comprised between 30 and 1000 W*min/$m^2$, still more preferably between 190 and 800 W*min/$m^2$.

As hereinbefore described, the plant 1 can advantageously comprise at least one control unit 9; such unit is active on the conveyor belt 2 and on the plasma-treating device 11 and is configured for:

- commanding the movement of the conveyor belt 2,
- controlling at least one operative parameter of the plasma-treating device 11 as a function of the movement imparted to the conveyor belt 2.

Particularly, the control unit 9 is active on the electrodes and on the generator of the circuit, and is configured for:

- receiving from a sensor, a signal related to the movement of the conveyor belt 2,
- determining, as a function of said signal, a movement speed of the sheet fibrous material T along the advancement direction A,
- as a function of the movement speed of the fibrous material T, commanding the value of at least one operative parameter of the plasma-treating device 11, selected among:
- the potential difference between two or more electrodes,
- the intensity of the current of the electric field generator, flowing in the circuit,
- a current frequency of the generator,
- the maximum distance of the active surfaces between the first and second electrodes,
- the minimum distance between the active surface of each electrode and the sheet fibrous material, particularly between the active surface of each electrode and the second side T2 of the sheet fibrous material,
- the dose parameter.

Controlling the operative parameter by the control unit, enables to obtain a desired variation of the surface hydrophobicity of the fibrous material T.

As it is visible in the attached figures, the plant 1 can comprise a treating station 10 which can be placed upstream or downstream the printing station 6 (see for example FIGS. 1 and 3 respectively illustrating a configuration of the plant 1, the treating station 10 being upstream and downstream the printing station 6). The attached figures illustrate a configuration wherein the plant 1 comprises, in a non limiting way, both the preparing station 4 and treating station 10 (see for example FIGS. from 1 to 4); however, it is not excluded the possibility of having a plant 1 only with the preparing station 4 (this condition is not illustrated in the attached figures) or only with the treating station 10 (see FIG. 10, for example). Referring to a variant of the plant 1 wherein both the stations 4 and 10 are present, the treating station 10 is distinct and separated from the preparing station 4 and is placed downstream this latter with respect to the advancement direction A of the sheet fibrous material T. The treating station 10 is configured for placing on the sheet fibrous material T a predetermined quantity of the treatment composition N comprising at least one of: a treatment liquid and a treatment foam. As illustrated in FIG. 1, the treating station 10 can be placed outside the conveyor belt 2 (upstream or downstream the conveyor belt 2) so that the sheet fibrous material T is treated—by the treatment composition N—before the same sheet fibrous material T contacts the conveyor belt (before the operative tract 3) or after said belt 2. FIGS. 2-4 illustrate a further variant of the treating station 10 wherein the same is placed at the conveyor belt 2: in this latter configuration, the treating station 10 is configured for disposing on the sheet fibrous material T, placed on the operative tract 3, the treatment composition N.

As hereinbefore described in an embodiment of the invention, the conveyor belt 2 defines an operative condition wherein the same continuously moves the sheet fibrous material T constantly at a speed greater than 0; the treating station 10 is configured for placing, during the predetermined operative condition, on the sheet fibrous material T the treatment composition N. More particularly, the treating station 10 and printing station 6 are located immediately consecutive to each other along the advancement direction A of the sheet fibrous material T: as it is visible in FIG. 2, the treating station 10 is immediately downstream the printing station 6 or, as illustrated in FIG. 3, can be placed immediately upstream the advancement direction A of the sheet fibrous material T.

The conveyor belt 2, during the operative condition, is configured for continuously moving the sheet fibrous material T through the treating station 10 and printing station 6. Particularly, between the treating station 10 and printing station 6 there are no material-treating stations, for example a station for drying the sheet fibrous material T.

The treatment composition N, which can be a treatment liquid or foam, dispensed from the treating station 10 can, for example, comprise at least one of the following agents: an anti-migration agent, a pH control agent, a hydrotropic agent.

In a preferred but non limiting configuration of the invention, wherein the plant 1 comprises both the preparing station 4 and the treating station 10, this latter is configured for dispensing a treatment composition N different from the treatment composition M dispensed from the preparing station 4; particularly, the treatment composition N dispensed from the treating station substantially comprises:

- at least one pH control agent, preferably selected among sodium bicarbonate, sodium carbonate, ammonium sulfate, ammonium tartrate, and citric acid, and
- at least one hydrotropic agent, preferably selected between urea and thiourea.

Also in the configuration, wherein the plant 1 comprises only the treating station 10, the treatment composition N supplied by this latter, can comprise at least one of: a treatment liquid, a treatment foam.

The treating station 10 is configured for placing, on the sheet fibrous material T sliding on the operative tract 3 of the conveyor belt 2, a predetermined quantity of the treatment composition N; said quantity of the treatment composition N is selected so that the sheet fibrous material T itself exhibits a weight percentage per square meter variation, between a section immediately upstream and one immediately downstream the treating station 10, less than 70%, particularly comprised between 10% and 50%, still more particularly comprised between 10% and 50%.

As hereinbefore described in a preferred but non limiting configuration of the invention, the plant 1 comprises the control unit 9. In such configuration, the control unit 9 is active on the treating station 10 and is configured for:

- commanding the movement of the conveyor belt 2,
- commanding the treating station 10 in order to manage the application of the predetermined quantity of the treatment composition N on the sheet fibrous material T.

Specifically, the control unit 9 is configured for:

- receiving, for example from the sensor engaged with the conveyor belt 2, a signal related to the movement of the conveyor belt 2,
- calculating, as a function of said signal, the movement speed of the sheet fibrous material T along the advancement direction A,
- as a function of the movement speed of the fibrous material T, commanding to dispense a predetermined quantity of the treatment composition N.

The predetermined quantity of the treatment composition N, managed by the control unit 9, is selected so that the sheet fibrous material T itself exhibits a weight percentage per square meter variation, between a section immediately upstream and one immediately downstream the treating station 10, less than 70%, particularly comprised between 10% and 50%, still more particularly between 10% and 30%. Optionally, said quantity of the treatment composition N, managed by the control unit 9, is selected so that the sheet fibrous material itself exhibits a weight percentage per square meter variation, between a section immediately downstream the treating station 10 and one immediately upstream the printing station 6, comprised between 0% and 10%.

Further, the control unit 9 can be configured for managing the movement speed of the conveyor belt 2 so that, during the operative condition of the same, the travelling time of a point of the sheet fibrous material T, from an outlet of the treating station 10 to an inlet of the printing station 6, is less than 60 sec, particularly less than 30 sec, still more particularly in a time comprised between 0.5 and 20 sec; such condition is managed by the control unit 9 in the configuration wherein the treating station 10 is placed upstream the printing station 6.

The treating station 10 comprises an applicator 12 configured for placing, on the second side T2 of the sheet fibrous material T, particularly placed on the operative tract 3, the treatment composition N. In case of a plant 1 comprising the control unit 9, this latter is active on the applicator 12 and is configured for commanding to dispense the treatment composition N.

As it is visible in FIGS. from 5 to 9, the applicator 12 of the treating station 10 can comprise one or more of the elements described with reference to the applicator 5 of the preparing station 4 (the applicators 5 of the preparing station 4 were hereinbefore described in the examples from 1 to 5).

In a preferred but non limiting embodiment of the plant 1, the treating station 10 comprises an applicator 12 configured for applying, on the second side T2 of the sheet fibrous material T, a quantity of the treatment foam; such applicator 12 is configured for dispensing, on the sheet fibrous material T, a quantity of foam exhibiting, immediately downstream the applicator 12, a thickness less than 2 mm, particularly less than 1.5 mm. The applicator 12 can comprise a configuration as illustrated in FIGS. from 5 to 9 and as hereinbefore described with reference to the applicator 5. Such foam dispensers are connected and therefore supplied by a foam generator 13 (see FIG. 10, for example) configured for generating the treatment foam and for supplying the applicator 12, continuously or at predetermined time intervals, with quantities of the treatment foam.

More particularly, the treating station 10 is configured for placing, on the second side T2 of the sheet fibrous material T, a quantity selected so that the sheet fibrous material T itself exhibits a weight percentage per square meter variation, between a section immediately upstream the treating station 10, wherein the fibrous material has not received the foam, and a section immediately downstream where the fibrous material has received said foam, comprised between 10% and 50%. Particularly, said predetermined quantity of treatment foam is selected so that the sheet fibrous material T itself exhibits a weight percentage per square meter variation, between said section immediately upstream the treating station 10 and a section immediately upstream the printing station 6, comprised between 10% and 50%; obviously, this latter described condition refers to the configuration of the plant 1 wherein the treating station 10 is placed upstream the printing station 6.

Advantageously, the foam applicator 12 of the treating station 10 is configured for defining, on the second side T2 of the fibrous material, at least one of:

- a continuous foam layer adapted to cover at least partially the second side T2 of the sheet fibrous material T,
- a plurality of discrete foam areas, such foam discrete areas defined on the second side T2 of the sheet fibrous material T being completely surrounded by the foam-uncovered fibrous material.

As hereinbefore described, in a configuration of the plant 1, the same comprises a control unit 9 which is active at least on the conveyor belt 2 and on the printing station 6; moreover, the control unit 9 is active on the applicator 12 of the treating station 10. The control unit 9 is configured for:

- commanding the movement of the conveyor belt 2, particularly for defining the operative condition of the conveyor belt wherein the same is continuously moved constantly at a speed greater than 0,
- a desired value of at least one operative parameter representative of a quantity of treatment foam applied on the sheet fibrous material, said at least one operative parameter comprising at least one of the following:
- a weight percentage per square meter variation of the sheet fibrous material between a section immediately upstream the treating station 10, wherein the fibrous material has not received the foam, and a section immediately downstream the treating station 10, wherein the fibrous material has received the foam,
- a weight percentage per square meter variation of the sheet fibrous material between said section immediately upstream the treating station 10 and a section immediately upstream the printing station 6,
- a volume flow rate of the treatment foam exiting said treating station,
- a mass flow rate of the treatment foam exiting said treating station,
- a thickness of the foam at the section immediately downstream the treating station,
- commanding the foam applicator 12 in order to manage the application of the treatment foam on the sheet fibrous material T, as a function of the desired value of the operative parameter and of the movement imparted to said conveyor belt 2, and therefore as a function of the sliding speed of the sheet fibrous material T along the advancement direction A.

Particularly, the plant 1 comprises at least one sensor capable of emitting a signal related to the motion of the conveyor belt 2; the control unit 9 is configured for:

- receiving from the sensor, a signal related to the movement of the conveyor belt 2,
- determining, as a function of said signal, a movement speed of the sheet fibrous material T along the advancement direction A,
- as a function of the movement speed of the fibrous material T, commanding to dispense the treatment foam for satisfying the desired value of said at least one operative parameter, optionally in order to satisfy the desired values of at least of the following operative parameters:
- the foam exhibits, immediately downstream the treating station 10, a thickness less than 2 mm, particularly less than 1.5 mm,
- the weight percentage per square meter variation of the sheet fibrous material, between a section immediately upstream the treating station 10, wherein the fibrous material has not received the foam, and a section immediately downstream the treating station 10, wherein the fibrous material has received the foam, is comprised between 10% and 50%,
- the weight percentage per square meter variation of the sheet fibrous material, between said section immediately upstream the treating station 10, and said section immediately upstream the printing station 6, is comprised between 10% and 50%.

The plant 1, provided with the conveyor belt 2 and printing station 6, can therefore comprise:

- one or more preparing stations 4 placed upstream the printing station 6 (in this configuration of the plant, the treating station 10 is not provided),
- one or more treating stations 10, each treating station 10 can be placed upstream or downstream the printing station 6 (in this configuration of the plant, the preparing station 4 is not provided),
- at least one preparing station 4 and at least one treating station 10 distinct and separated from each other. In such configuration, the treating station 10 is always placed downstream the preparing station 4 with respect to the advancement direction A of the sheet fibrous material T. However, the treating station 10 can be placed, also in this configuration, upstream or downstream the printing station 6 with respect to the advancement direction A of the sheet fibrous material T. Preferably but in a non-limiting way, in such configuration, the treatment composition M dispersed from the preparing station 4, is different from the treatment composition N dispersed from the treating station 10; for example, the treatment composition M can substantially comprise an anti-migration agent, while the treatment composition N can substantially be a pH control agent and a hydrotropic agent.

The attached figures illustrate, in a non limiting way, an embodiment of the plant wherein the treating station 10 is placed at the operative tract 3; the above described treating station 10 is configured for treating at least part of the second side T2 of the sheet fibrous material T by placing the treatment composition N (treatment liquid or foam) of the second side T2 placed on the operative tract 3 of the belt 2: the predetermined quantity of the treatment composition N is directly placed on the second side T2.

In an embodiment variant not illustrated in the attached figures, the treating station 4 is upstream or downstream the operative tract 3 of the belt 2 and is configured for treating the fibrous material by a deposition of the treatment composition N on the first side T1 and by a migration of the composition N through the fibrous material: in this way, the migration of the composition N from the first to the second sides T2 causes an indirect deposition of the predetermined quantity of the treatment composition N on the second side T2.

The treatment composition N, as hereinbefore described, can comprise a treatment liquid and/or foam. The treating station 10 is configured for enabling to directly apply the treatment composition N on the first side T1 of the fibrous material T opposite to the side T2; such direct application can occur by at least one of:

- a direct placement of the composition on the first side T1 of the fibrous material T; or
- a direct deposition on the exposed surface S of a deposition length of the conveyor belt 2 placed upstream the operative tract 3.

As hereinbefore specified, the operative tract 3 is the portion of the belt 2, in contact with the material T. In case of an application of the treatment composition N on the first side T1 or on the exposed surface S of the belt 2, such composition N is configured for initially directly contacting only the first side T2 of the fibrous material; upon the placement of the fibrous material on the conveyor belt 2 in order to define said operative tract 3, the treatment composition is thrusted—for example by means of a doctor blade or one or more pressure rolls—through the sheet fibrous material from the first side T1 for enabling to treat the fibrous material and particularly to indirectly treat the second side T2.

In a preferred but non limiting embodiment of the just described embodiment variant, the treatment composition N is directly applied on the exposed surface S of the conveyor belt 2; then, the composition is guided by the belt 2 to an initial contact area of the fibrous material T against the belt 2. At the initial contact area, means for bonding the fibrous material T to the belt, are present. For example, said bonding means can comprise at least one of: one or more pressure rolls, a doctor blade. Such bonding means are configured for pressing the sheet fibrous material T on the belt 2 and therefore for enabling to indirectly treat the second side T2 by the migration of the treatment composition through the fibrous material from the first side T1 to the second side T2.

In the just described embodiment variant, the treating station 10 can comprise an applicator of the type as hereinbefore described.

As it is visible in the attached figures, the plant can comprise a supplying station 14 configured for supplying the sheet fibrous material to the conveyor belt 2. When the preparing station 4 and/or treating station 10 are between the conveyor belt 2 and supplying station 14, the supplying station 14 is configured for directly supplying such stations 4 and/or 10. See for example FIG. 1 wherein the supplying station 14 is adapted to directly supply the preparing station 4. FIG. 10 instead illustrates a configuration of the plant 1 wherein the supplying station 14 directly supplies the treating station 10.

The supplying station 14 can comprise a roll of sheet material T placed on a drum rotatively commanded by a motor. The fibrous material T is unwound from the drum and supplied to the conveyor belt 2. In a preferred but non limiting embodiment of the invention, the plant 1 comprises a control unit 9 active on the supplying station 14, and configured for:

- receiving from a sensor, a signal related to the movement of the conveyor belt 2,
- determining, as a function of said signal, a movement speed of the sheet fibrous material T along the advancement direction A,
- as a function of the movement speed of the fibrous material T, commanding a predetermined rotation speed of the drum so that the speed of the conveyor belt 2 is synchronized with the rotation speed of the drum.

In an embodiment variant of the invention, the sheet fibrous material T can be withdrawn from a different supplying station 14 configured for depositing the sheet fibrous material T as flat planes or as bends (this condition is not illustrated in the attached figures). Moreover, it is not excluded the possibility of directly withdrawing the sheet fibrous material exiting from a further material T treating plant such as for example a rameuse machine.

As it is visible in the attached figures, further the plant 1 can comprise a vapourizer 15 (typically known in the field as "vapour treating devices" or "steam agers") placed downstream the printing station 6 and particularly at the outlet from the conveyor belt 2. The vapourizer 15 is configured for drying the sheet fibrous material T having the print in order to execute a fixing treatment of the printing ink on the material T: the printed material is contained in an environment having a vapour at conditions of pressure and temperature suitable for ensuring to fix the ink to the fibers of the material.

As it is visible in the attached figures, further the plant 1 can comprise at least one drying station 16 placed downstream the printing station and configured for drying the sheet fibrous material T. FIGS. 1 and 2 show a configuration of the plant 1 wherein the drying station 16 is placed downstream the conveyor belt 2 with respect to the advancement direction A of the fibrous material T; however, it is not excluded the possibility of placing a drying station at the conveyor belt 2 so that the same can dry the fibrous material placed on the operative tract 3 (at the outlet from the printing station 6). In a preferred but non limiting embodiment of the invention, the drying station 16 is placed downstream the vapourizer 15 with respect to the advancement direction A of the sheet fibrous material T.

As it is visible in FIGS. 1, 2 and 10, further the plant 1 can comprise a station 17 for gathering the printed sheet fibrous material T. The gathering station is a terminal station placed downstream all the treating and printing stations provided for the plant 1. As it is schematically shown in FIGS. 1 and 2, the gathering station 17 is immediately placed downstream the drying station 16. However, the gathering station can—in the absence of the vapourizer 15 and drying station 16—be placed immediately downstream the conveyor belt 2 with respect to the advancement direction A of the sheet fibrous material T (FIG. 10). The gathering station 17 can comprise a drum, rotatively commanded by a motor, on which the printed fibrous material is wound.

In a preferred but non limiting embodiment of the invention, the control unit 9 active on the gathering station 14 is configured for:

receiving from a sensor, a signal related to the movement of the conveyor belt 2, determining, as a function of said signal, a movement speed of the sheet fibrous material T along the advancement direction A, as a function of the movement speed of the fibrous material T, adjusting the rotation speed of the drum of the gathering station 17 so that as the drum diameter varies or the conveyor belt speed varies, the speed of the fabric exiting the conveyor belt is equal to the peripheral speed of the drum of the gathering station.

In an embodiment variant of the invention, the printed sheet fibrous material T can be deposited in a different gathering station as flat planes or as bends (this condition is not illustrated in the attached figures). Moreover, it is not excluded the possibility of directly supplying the printed sheet fibrous material exiting the printing station 6—or exiting the vapourizer or exiting the drying stations if present—to a further material T treating plant.

Printing Process

Moreover, it is an object of the present invention a process for printing a sheet fibrous material T. The process comprises a step of storing the sheet fibrous material T, for example from the supplying station 14, and supplying the same to the conveyor belt 2. Particularly, the process can comprise a step of unwinding the sheet fibrous material T from the drum of the supplying station 14.

The process comprises placing the first side T1 of the sheet fibrous material T in contact with the exposed surface of the conveyor belt 2 so that the same can define the operative tract 3 wherein the belt 2 supports the fibrous material. Advantageously, but in a non limiting way, the sheet fibrous material T is constrained (by applying an adhesive material, for example), to the exposed surface of the belt 2 so that this latter can stably support said moving material T. The conveyor belt 2 moves the sheet fibrous material T along the advancement direction A. In a preferred but non limiting configuration of the invention, the conveyor belt 2 continuously moves the sheet fibrous material T along an advancement direction A at a speed constantly greater than 0 (an operative condition of the conveyor belt 2). More particularly, the sheet fibrous material T is continuously moved along the advancement direction A at a speed constantly comprised between 20 and 100 m/min, particularly comprised between 30 and 70 m/min.

The process comprises a step of ink-printing, particularly of digitally printing, the second side T2 opposite to the first side T1, of the sheet fibrous material T in contact with the conveyor belt 2. The printing step is executed in the printing station 6 which is adapted to ink-print, particularly to digitally print, the sheet fibrous material T; as hereinbefore described, the printing station 6 comprises at least one printing module 7 which, during the movement of the sheet fibrous material T (an operative condition of the conveyor belt 2), stays in a fixed position and prints on the whole width of the sheet fibrous material T. Plural printing modules 7 (for example from 3 to 10) can be provided, placed parallel to each other straddling the conveyor belt and consecutively placed along the advancement direction A; for example the printing heads of each module can be supplied by a respective ink in order to obtain any desired chromatic combination.

Moreover, the process can comprise a preparing step which provides to prepare (treat) at least part of the second side T2 of the fibrous material T by the preparing station 4; the preparing step is executed before the printing step, so that the sheet fibrous material is treated and then printed in the station 6.

The preparing step can be executed on the sheet fibrous material before the same is placed in contact with the conveyor belt and therefore outside the operative tract 3 (see FIG. 1, for example); as an alternative, the preparing step is performed on the sheet material in contact with the belt and particularly abutting on the operative tract 3 as illustrated in FIG. 4.

In a first embodiment of the invention, the preparation step of the sheet fiber material T comprises placing on the material T a predetermined amount of treatment composition M which comprises at least: a treatment liquid and a foam treatment.

As hereinbefore described, the step of moving the belt 2 can be continuously moved constantly at a speed greater than 0 (an operative condition of the conveyor belt 2); the step of placing the treatment composition on the material T can be advantageously executed during the continuous movement of the belt 2, in other words during the operative condition of this latter. The preparing step and printing step are executed one immediately after the other during the continuous movement of the fibrous material along the advancement direction A. In an embodiment of the invention, the prepared material exiting the preparing station 4 is not subjected to any other type of treatment before the printing step. In this first embodiment of the invention, the treatment composition M, can be a treatment liquid or foam, dispensed during the preparing step, can comprise at least one of the following agents: an anti-migration agent, a pH control agent, a hydrotropic agent.

The preparing step provides to place on the second side T2 of the material T, a predetermined quantity of the treatment composition M: the treatment composition M is selected so that the sheet fibrous material T itself exhibits a weight percentage per square meter variation, between a section immediately before and immediately after the preparing step, less than 70%, particularly comprised between 10% and 50%, still more particularly comprised between 10% and 30%. More particularly, the quantity of the treatment composition M dispensed during the preparing step, is selected so that the sheet fibrous material T itself exhibits a weight percentage per square meter variation, between a section immediately before the preparing step and a section immediately before the printing step, less than 70%, particularly comprised between 10% and 50%, still more particularly comprised between 10% and 50%. In other words, the preparing step places on the sheet fibrous material T—sliding on the operative tract 3 of the conveyor belt 2—a predetermined quantity of the treatment composition M selected so that the sheet fibrous material T itself exhibits a weight percentage per square meter variation, between a section immediately after the preparing step and a section immediately before the printing step, comprised between 0% and 10%.

The movement of the conveyor belt 2 is executed so that the sheet fibrous material T exiting the preparing step, is substantially immediately treated without the same being subjected to the drying step. Particularly, the time required by a point of the sheet fibrous material T, to move immediately after the preparing step and immediately before the printing step, is less than 60 sec, particularly is less than 30 sec, still more particularly is comprised between 0.5 and 20 sec. Considering again the first embodiment of the preparing step, this latter can comprise a step of selecting the predetermined quantity of the composition M as a function of the movement speed of the belt 2 and therefore of the movement speed of the fibrous material T along the advancement direction A. Particularly, the process comprises the following step:

detecting a desired value of at least one operative parameter representative of a quantity of the treatment composition applied on the sheet fibrous material during the preparing step, said at least one operative parameter comprising at least one of the following:

a weight percentage per square meter variation of the sheet fibrous material immediately before the preparing step, wherein the fibrous material has not received the treatment composition, and immediately after the preparing step, wherein the sheet fibrous material T has received the treatment composition M, a volume flow rate of the treatment composition immediately after the preparing step, a mass flow rate of the treatment composition immediately after the preparing step, managing the application of the treatment composition on the sheet fibrous material T, as a function of the desired value of the operative parameter and of the movement imparted to said conveyor belt 2.

If the treatment composition M dispensed during the preparing step comprises a treatment foam, the process can comprise the following steps:

receiving, from a sensor, a signal related to the movement of the conveyor belt 2, determining, as a function of said signal, a movement speed of the sheet fibrous material T along the advancement direction A, as a function of the movement speed of the fibrous material T, commanding to dispense the treatment foam for satisfying the desired value of said at least one operative parameter, optionally in order to satisfy the desired values of at least one of the following operative parameters:

the foam exhibits, immediately after the preparing step, a thickness less than 2 mm, the weight percentage per square meter variation of the sheet fibrous material, immediately before the preparing step, wherein the fibrous material has not received the foam, and immediately after the preparing step, wherein the fibrous material has received the foam, is comprised between 10% and 50%.

Figure 8:
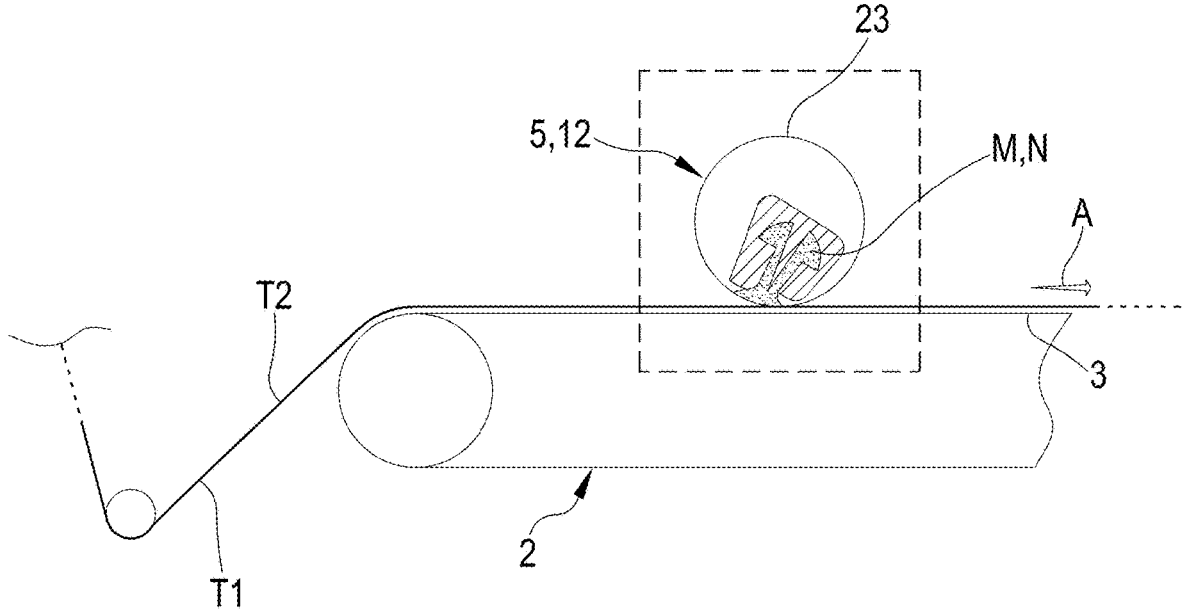

The preparing step provides to deposit the treatment composition M by one or more of the following methods:

coating by the doctor blade 19 placed transversally to the motion of the conveyor belt and spaced above the operative tract (FIG. 7), spray dispensing at a distance above the operative tract (by the dispenser 18—FIG. 6), coating by an applicator roll with an associated respective doctor blade for adjusting a thickness of the treatment composition deposited on a lateral surface of the applicator roll, this latter being placed with the rotation axis transversal to the motion of the conveyor belt and with the lateral surface spaced above the operative tract of the conveyor belt, dispensing by the drum 23 (FIGS. 8 and 11) placed with the rotation axis transversal to the motion of the conveyor belt and with the lateral surface spaced above the operative tract of the conveyor belt, the drum exhibiting a hollow interior destined to receive a predetermined quantity of the treatment composition and being provided with a predetermined number of nozzles or slits for dispensing the same, coating by the distributor (FIG. 9).

As an alternative, the step of preparing the fibrous material can provide to dispense the treatment composition M on the first side T1 of the material T before this latter contacts the conveyor belt 2. Such step can provide to directly apply the composition M directly on the first side T1 of the sheet fibrous material spaced from the belt 2. As an alternative, the treatment composition M can be directly applied on the exposed surface S of the conveyor belt 2, in correspondence of a depositing length upstream the operative tract. The composition placed on the first side T1 (the side opposite to the print side), at an initial contact area between the belt 2 and material T, is thrusted through the sheet fibrous material from the first side T1 for enabling to treat this latter.

In a second embodiment of the invention, the preparing step of the fibrous material T provides at least one step configured for modifying the surface hydrophobicity of at least part of the sheet fibrous material itself. More particularly, the preparing step increases the surface hydrophobicity of at least part of the sheet fibrous material T passing through the preparing station 4. Specifically, the preparing step is configured for increasing the surface hydrophobicity of the whole second side T2 of the sheet fibrous material T passing through the preparing station 4. Quantitatively, the ratio between the hydrophobicity of a section of the second side T2 of the fibrous material immediately before the preparing step and the hydrophobicity of a section of the second side T of the fibrous material immediately after the preparing step, is greater than 1.1, particularly greater than 1.5, still more particularly comprised between 1.5 and 5.

As hereinbefore described, in an embodiment of the invention, the conveyor belt 2 defines an operative condition wherein the same continuously moves the sheet fibrous material T constantly at a speed greater than 0; the preparing step (in the second embodiment thereof) is executed during the continuous movement of the belt (an operative condition of the belt) so that the hydrophobicity of the fibrous material T can be increased, during said operative condition of the belt. More particularly, the preparing step and printing step 6 are executed one immediately after the other; the conveyor belt 2, during the operative condition, moves the sheet fibrous material T between the preparing step and printing step.

More particularly, the preparing step (second embodiment) comprises a plasma treatment defining a treating environment where at least one portion of the sheet fibrous material T is received wherein is present an ionized gas. The plasma treatment generates plasma in said treating environment by using one or more of the following gases: air, nitrogen, nitrogen oxide (NO), ammonia, inert gases such as for example argon and helium, oxygen, hydrogen, carbon dioxide ($CO_2$), fluorinated gases such as for example $SF_6$ and $SOF_6$, hydrocarbon gases such as for example methane and ethane, fluorocarbon gases such as for example $CF_4$ and $C_2F_6$, alone or in a mixture, preferably nitrogen, still more preferably 2 $l_n$/min nitrogen. As an alternative, the plasma-treating step generates plasma in a treating environment by using one or more of said gases mixed with one or more of: water vapour, ammonium hexamethyldisiloxane (HMDSO) vapours, and vapours of other silanes, siloxanes, hydrocarbons and perfluorinated compounds.

The plasma treatment is executed by the device 11 as hereinbefore specifically described. The treating step provides to continuously move the sheet fibrous material T between the first and second electrodes along the advancement direction A; in other words, during the plasma-treating step, the sheet fibrous material T is continuously moved at a speed constantly greater than 0. The treatment provides to define between said electrodes a potential difference comprised between 1 and 50 kV, particularly between 5 and 25 kV. The plasma-treating step further provides to manage the current flowing inside the circuit on which the electric field generator and electrodes are active: the current intensity in the circuitry falls in a range comprised between 100 and 200 A, preferably at 180 A. The supplying frequency of the electrodes is greater than 1 kHz, particularly is comprised between 1 and 20 kHz. The plasma-treatment is substantially executed at the atmospheric pressure; de facto, the device 11 is substantially open to the environment so that the sheet fibrous material can continuously slide between the electrodes (continuously slides through the preparing station 4). More particularly, the current discharge between the electrodes develops at a pressure comprised between 600 and 1500 mbar, still more preferably between 800 and 1200 mbar.

Moreover, the plasma-treating step transmits a predetermined power of the electric discharge between the electrodes per surface unit of the processed sheet fibrous material T; such parameter can be defined as a dose and is measured in W*min/$m^2$. The value of the dose transmitted during the plasma-treating step is less than 300 W*min/$m^2$, preferably is comprised between 30 and 1000 W*min/$m^2$, still more preferably between 190 and 800 W*min/$m^2$.

In a preferred embodiment of the invention, the plasma-treating step is controlled as a function of the movement speed of the fibrous material T along the advancement direction A, particularly, the plasma-treating step comprises the following steps:

- commanding the movement of the conveyor belt 2,
- controlling at least one operative parameter of the plasma treatment 11 as a function of the movement imparted to the conveyor belt 2.

Still more particularly, the plasma-treatment step comprises the following steps:

- receiving, from a sensor, a signal related to the movement of the conveyor belt 2,
- determining, as a function of said signal, a movement speed of the sheet fibrous material T along the advancement direction A,
- as a function of the movement speed of the fibrous material T, commanding the value of at least one operative parameter of the plasma treatment selected among:
- a potential difference between the first and second electrodes 11*a*, 11*b* defined by the electric field generator,
- a current intensity in the circuit which puts in communication the generator with the electrodes;
- a current frequency of the electric field generator;
- the distance of the electrodes of the sheet fibrous material;
- a parameter of a dose defined by a power transmitted by an electric discharge generated by the same plasma-treating device 11 per surface unit of the sheet fibrous material T moving from the preparing station 4.

The parameter enables to manage the plasma-treating process in order to obtain a desired variation of the surface hydrophobicity of the fibrous material. The process, according to the present invention, can comprise a treating step which can be executed before or after the step of printing the sheet material T. The process can comprise both the preparing step and the treating step; however, it is not excluded the possibility of executing a process having only the preparing step (this condition is not illustrated in the attached figures), or only the treating step (see FIG. 10, for example). Referring to a variant of the process wherein both the (preparing and treating) steps are present, the treating step is distinct and separated from the preparing step and is executed immediately after this latter.

The treatment step provides to place on the sheet fibrous material T a predetermined quantity of the treating station N comprising at least one of: a treatment liquid and treatment foam. The treatment step can be executed outside the conveyor belt 2 (upstream or downstream the conveyor belt 2) so that the sheet fibrous material T is treated—by the treatment composition N—before the same sheet fibrous material T contacts the conveyor belt 2 (before the operative tract 3) or exiting said belt 2. FIGS. from 2 to 4 illustrate a further variant wherein the treating step—executed by the station 10—is executed on the fibrous material contacting the belt 2: in this latter configuration, the treating step provides to place the treatment composition N on the sheet fibrous material T located on the operative tract 3.

As hereinbefore described, in an embodiment of the invention, the conveyor belt 2 defines an operative condition wherein the same continuously moves the sheet fibrous material T constantly at a speed greater than 0; the treating step places the treatment composition N on the fibrous material, during the predetermined operative condition of the belt 2. More particularly, the treating step 10 and printing step 6 are executed one immediately after the other.

The treatment composition N, which can be a treatment liquid or foam, supplied during the treatment step (treating station 10) can, for example, comprise at least one of the following agents: an anti-migration agent, a pH control agent, a hydrotropic agent.

In a preferred configuration of the invention wherein the process comprises both the preparing step and treating step, this latter is configured for dispensing a treatment composition N different from the treatment composition M dispensed during the preparing step; particularly the treatment composition N dispensed from the treating station comprises:

- at least one pH control agent, preferably selected among sodium bicarbonate, sodium carbonate, ammonium sulfate, ammonium tartrate, and citric acid, and
- at least one hydrotropic agent, preferably selected between urea and thiourea.

Also in the configuration, wherein the process comprises only the treating step 10, the dispensed treatment composition N can comprise at least one between: a treatment liquid, a treatment foam.

The treating step enables to place, on the sheet fibrous material T sliding on the operative tract 3 of the conveyor belt 2, a predetermined quantity of the treatment composition N; said quantity of the treatment composition N is selected so that the sheet fibrous material T itself exhibits a weight percentage per square meter variation, immediately before and immediately after the treating step, less than 70%, particularly comprised between 10% and 50%, still more particularly comprised between 10% and 50%.

In a preferred but non limiting embodiment of the invention, dispensing the predetermined quantity of the material N during the treating step is managed and controlled as a function of the movement speed of the fibrous material T along the advancement direction A. The treating step comprises a step of selecting the predetermined quantity of the composition N as a function of the movement speed of the belt 2 and therefore of the movement speed of the fibrous material T along the advancement direction A. Particularly, the process comprises the following steps:

detecting a desired value of at least one operative parameter representative of a quantity of the treatment composition applied on the sheet fibrous material during the treating step, said at least one operative parameter comprising at least one of the following:

a weight percentage per square meter variation of the sheet fibrous material immediately before the treating step, wherein the fibrous material has not received the treatment composition, and immediately after the treating step, wherein the sheet fibrous material T has received the treatment composition T, a volume flow rate of the treatment composition immediately after the treating step, a mass flow rate of the treatment composition immediately after the treating step, managing the application of the treatment composition N on the sheet fibrous material T, as a function of the desired value of the operative parameter and of the movement imparted to said conveyor belt 2.

The treating step provides to deposit the treatment composition N by one or more of the following methods:

coating by the doctor blade 19 placed transversally to the motion of the conveyor belt and spaced above the operative tract (FIG. 7), spray dispensing at a distance above the operative tract (by the dispenser 18—FIG. 6), coating by the applicator roll with an associated respective doctor blade for adjusting a thickness of the treatment composition deposited on a lateral surface of the applicator roll, this latter being placed with the rotation axis transversal to the motion of the conveyor belt and with the lateral surface spaced above the operative tract of the conveyor belt, dispensing, by the drum 23 (FIGS. 8 and 11) placed with the rotation axis transversal to the motion of the conveyor belt and with the lateral surface spaced above the operative tract of the conveyor belt, the drum exhibiting a hollow interior destined to receive a predetermined quantity of the treatment composition and being provided with a predetermined number of nozzles or slits for dispensing the same, coating by the distributor (FIG. 9).

In an embodiment of the process, the treating step provides to apply a predetermined quantity of the treatment composition comprising a foam; the foam quantity applied immediately after the treating steps exhibits a thickness less than 2 mm, particularly less than 1.5 mm. The treating step by the foam can be executed by an applicator 5, 12 as hereinbefore described with reference to the plant 1. This treatment provides to form the foam by a foam generator 13 which then supplies a predetermined quantity of the treatment foam—continuously or at time intervals—to the applicator. The foam treating step provides to apply a material selected so that the same sheet fibrous material T exhibits a weight percentage per square meter variation, immediately before and immediately after the treating step (application of the foam), comprised between 10% and 50%, still more particularly comprised between 10% and 30%. The treatment by foam is further executed so that:

a continuous foam layer adapted to cover at least partially the second side T2 of the sheet fibrous material T, is dispensed, a plurality of discrete foam areas are dispensed, such foam discrete areas defined on the second side T2 of the sheet fibrous material T being completely surrounded by the fibrous material not covered by the foam.

Advantageously, the foam treating step is managed as a function of the speed of the conveyor belt; particularly, under such condition, the process comprises the following steps:

moving the conveyor belt 2, detecting a desired value of at least one operative parameter representative of the treatment foam applied on the sheet fibrous material, said at least one operative parameter comprising at least of the following:

a weight percentage per square meter variation of the sheet fibrous material immediately before the treating step, wherein the fibrous material has not received the foam, and immediately after the treating step, wherein same the fibrous material has received the foam, a weight percentage per square meter variation of the sheet fibrous material immediately after the treating step and immediately before the printing step, a volume flow rate of the treatment foam immediately after the treating step, a mass flow rate of the treatment foam immediately after the treating step, a thickness of the foam immediately after the treating step, commanding to dispense the treatment foam on the sheet fibrous material T, as a function of the desired value of the operative parameter and of the movement imparted to said conveyor belt 2.

Particularly, the foam treating step provides the following steps:

emitting, particularly by a sensor, a signal related to the motion of the conveyor belt, receiving the signal related to the movement of the conveyor belt 2, determining, as a function of said signal, a movement speed of the sheet fibrous material T along the advancement direction A, as a function of the movement speed of the fibrous material T, commanding to dispense the treatment foam for satisfying the desired value of said at least one operative parameter, optionally in order to satisfy the desired values of at least one of the following operative parameters:

the foam exhibits, immediately after the treating step, a thickness less than 2 mm, particularly less than 1.5 mm, the weight percentage per square meter variation of the sheet fibrous material, between a section immediately after the treating step, wherein the fibrous material has not received the foam, and a section immediately before the treating step, wherein the fibrous material has received the foam, is comprised between 10% and 50%, the weight percentage per square meter variation of the sheet fibrous material, between said section immediately before the treating step and said section immediately before the printing step, is comprised between 10% and 50%.

As an alternative, the treating step of the fibrous material T can provide to dispense the treatment composition N on the first side T1 of the material T before this latter contacts the conveyor belt 2. Such step can provide to directly apply the composition N directly on the first side T1 of the sheet fibrous material spaced from the belt 2. As an alternative, the treatment composition N can be directly applied on the exposed surface S of the conveyor belt 2, at a deposit length upstream the operative tract. The composition placed on the first side T1 (the side opposite to the print side), in correspondence of an initial contact area between the belt 2 and material T, is thrusted through the sheet fibrous material from the first side T1 for enabling to treat this latter.

The process, according to the present invention, can further comprise a step of supplying the sheet fibrous material T by the station 14. In the configuration of the process wherein the preparing step and/or treating step are provided, the supplying step enables to supply the sheet fibrous material directly towards the stations capable of executing such steps.

The supplying step can occur by unwinding a roll of the sheet material T placed on a drum rotatively commanded by a motor. In a preferred but non limiting embodiment of the invention, the process provides the following steps:

receiving, from a sensor, a signal related to the movement of the conveyor belt 2, determining, as a function of said signal, a movement speed of the sheet fibrous material T along the advancement direction A, as a function of the movement speed of the fibrous material T, commanding a predetermined rotation speed of the drum so that the speed of the conveyor belt 2 is synchronized with the rotation speed of the drum.

Moreover, the process can comprise a vapourizing step—by the vapourizer 15—executed after the step of printing the sheet fibrous material. The vapourizing step enables to execute a fixing treatment of the printing ink on the material T: the printed material is contained in an environment wherein the vapour is at pressure and temperature conditions suitable to ensure to fix the ink to the fibers of the material.

Moreover, the process can comprise a step of drying the printed fibrous material. The drying step can be executed on the material exiting the belt 2 or on the material placed on the operative tract of the conveyor belt 2. In a preferred but non limiting embodiment of the invention, the drying step is executed immediately after the vapourizing step.

Moreover, the process comprises a step of gathering the printed material, for example by the gathering station 17. The gathering step enables to bring together the printed material exiting the conveyor belt 2, for example around a gathering drum, for defining a roll of printed material, or as an alternative in a container for gathering the printed material as layers.

The invention claimed is:

1. A digital printing plant comprising:

a supply station configured to supply a sheet fibrous material, a conveyor belt with an exposed surface configured to receive in adhesion a first side of the supplied sheet fibrous material, the conveyor belt being also configured to move said sheet fibrous material along an advancement direction, a treatment station configured to treat at least part of the first side of the sheet fibrous material, a print station, disposed downstream of the treatment station, configured to digitally print at least part of a second side of the sheet fibrous material opposite the first side, wherein said treatment station is positioned and configured to deposit a treatment foam exclusively on the first side of the sheet fibrous material, whereby, when the plant is in operation, treatment foam applied by the treatment station reaches the second side of the sheet fibrous material exclusively by migrating through a thickness of the sheet fibrous material from the first side to the second side.

2. The plant according to claim 1, wherein the treatment station is operative at the conveyor belt and configured to deposit the treatment foam between the conveyor belt exposed surface and the first side of the sheet fibrous material, upstream of where the sheet fibrous material contacts the conveyor belt.

3. The plant according to claim 1, wherein the print station comprises a fixed printing module configured to print a full width of the second side of the sheet fibrous material.

4. The plant according to claim 1, void of any dryer active on the sheet fibrous material between the treatment station and the print station.

5. The plant according to claim 1, wherein the treatment station is configured to place on the sheet fibrous material a predetermined quantity of the treatment foam, said quantity being selected such that the sheet fibrous material exhibits a weight percentage difference per square meter, between a section immediately downstream of the treatment station and a section immediately upstream of the print station, of between 0% and 10% of the weight per square meter at the section immediately upstream of the treatment station.

6. The plant according to claim 1, wherein the treatment station and the print station are disposed immediately adjacent each other along the advancement direction of the sheet fibrous material, wherein the conveyor belt, during operation, is configured to continuously move the sheet fibrous material through the treatment station and the print station, and wherein the plant is void of any drying station drying the sheet fibrous material between the treatment station and the print station.

7. The plant according to claim 1, comprising at least one controller active on the conveyor belt and on the treatment station, said controller being configured to:

command movement of the conveyor belt, and to command the treatment station to apply a predetermined quantity of treatment foam on the sheet fibrous material as a function of the movement of the conveyor belt.

8. The plant according to claim 7, wherein said controller is further configured to:

receive a signal indicative of the movement of the conveyor belt, calculate, as a function of said received signal, a movement speed of the sheet fibrous material or of a conveyor belt operative tract adhering to the sheet fibrous material, and to command the treatment station to dispense a predetermined quantity of the treatment foam as a function of said calculated movement speed.

9. The plant according to claim 8, wherein the controller is configured to command the treatment station to dispense a predetermined quantity of the treatment foam as a function of said movement speed in a manner that provides for the sheet fibrous material to exhibit a weight percentage per square meter difference, between a section immediately upstream of the treatment station and a section immediately downstream of the treatment station, of between 10% and 50% of the weight per square meter at the section immediately upstream of the treatment station.

10. The plant according to claim 1, wherein the treatment station is configured to dispense a treatment foam comprising at least one of:

an anti-migration agent, a pH control agent, and a surfactant.

11. A method of digitally printing a sheet fibrous material using the plant of claim 1, wherein the process comprises the following steps: continuously supplying sheet fibrous material from the supply station, adhering the first side of the sheet fibrous material to the exposed surface of the conveyor belt, digitally printing at least part of the second side of the sheet fibrous material opposite said first side, and operating the conveyor belt and continuously moving the sheet fibrous material from the supply station, consecutively through the treatment station and the print station, with the sheet fibrous material continuously maintaining a speed higher than zero while digitally printing is taking place, wherein upstream of the print station the process provides for: depositing a treatment foam exclusively on the first side of the sheet fibrous material, allowing the deposited treatment foam to reach the second side of the sheet fibrous material exclusively by migrating through a thickness of the sheet fibrous material from the first side to the second side of the same sheet fibrous material; and wherein said step of digitally printing takes place is void of any active drying of the sheet fibrous material following the step of depositing the treatment foam, such that the weight percentage per square meter difference of the sheet fibrous material, between immediately after the treatment foam depositing step and immediately before the printing step, is between 0% and 10% of the weight per square meter immediately after the treatment foam depositing step.

12. The method according to claim 11, wherein depositing the treatment foam comprises depositing a quantity of the treatment between the conveyor belt exposed surface and the first side of the sheet fibrous material before the sheet fibrous material contacts the conveyor belt, wherein the weight percentage per square meter difference of the sheet fibrous material, between immediately before and immediately after the depositing step, is between 10% and 50% of the weight per square meter of the sheet fibrous material immediately before the depositing step, and wherein the sheet fibrous material is displaced at a speed such that a point of the sheet fibrous material moves from a point immediately after the depositing step and a point immediately before the printing step in a time of between 0.5 and 20 sec.

13. A method of digitally printing a sheet fibrous material, the method comprising the following steps:

moving the sheet fibrous material along an advancement direction, adhering a first side of the sheet fibrous material to an exposed surface of a conveyor belt, and digitally printing at least part of the second side of the sheet fibrous material opposite said first side, wherein, upstream of the digitally printing step, the process includes:

depositing a treatment foam exclusively on the first side of the sheet fibrous material, and allowing the deposited treatment foam to reach the second side of the sheet fibrous material by migrating through a thickness of the sheet fibrous material from the first side to the second side of the same sheet fibrous material.

14. The method according to claim 13, wherein depositing the treatment foam comprises depositing a quantity of the treatment between the conveyor belt and the first side of the sheet fibrous material upstream of the sheet fibrous material contacting the conveyor belt.

15. The method according to claim 13, wherein a weight percentage per square meter difference of the sheet fibrous material, between immediately before and immediately after depositing the treatment foam, is between 10% and 50% of the weight per square meter of the sheet fibrous material immediately before depositing the treatment foam.

16. The method according to claim 13, void of any active drying of the sheet fibrous material between depositing of the treatment foam and the digital printing, such that the weight percentage per square meter difference of the sheet fibrous material, between immediately after the treatment foam depositing and immediately before the printing, is between 0% and 10% of the weight per square meter of sheet fibrous material immediately after the treatment foam depositing.

17. The method according to claim 13, wherein the sheet fibrous material is displaced at a speed such that a point of the sheet fibrous material moves from a section immediately after the depositing step and a section immediately before the printing step in a time of between 0.5 and 20 sec.

18. The method according to claim 13, wherein depositing the treatment foam comprises depositing on the sheet fibrous material a predetermined quantity of the treatment foam calculated based on a movement speed of the sheet fibrous material or of a portion of the conveyor belt adhering to the sheet fibrous material.

19. The method according to claim 13, wherein the treatment foam comprises at least one of:

an anti-migration agent, a pH control agent, and a surfactant.

20. The method according to claim 13, wherein the printing step is performed in a digital printing station comprising a printing module which, during the movement of the sheet fibrous material, stays in a fixed position and prints on all the width of the sheet fibrous material.

* * * * *